US009478177B2

(12) United States Patent
Shiomi

(10) Patent No.: US 9,478,177 B2
(45) Date of Patent: Oct. 25, 2016

(54) DISPLAY DEVICE CONFIGURED TO PERFORM PSEUDO INTERLACE SCANNING IMAGE DISPLAY BASED ON PROGRESSIVE IMAGE SIGNAL, DRIVING METHOD THEREOF, AND DISPLAY DRIVING CIRCUIT

(75) Inventor: Makoto Shiomi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 104 days.

(21) Appl. No.: 13/976,130

(22) PCT Filed: Dec. 21, 2011

(86) PCT No.: PCT/JP2011/079616

§ 371 (c)(1),
(2), (4) Date: Jun. 26, 2013

(87) PCT Pub. No.: WO2012/090814

PCT Pub. Date: Jul. 5, 2012

(65) Prior Publication Data

US 2013/0271436 A1 Oct. 17, 2013

(30) Foreign Application Priority Data

Dec. 28, 2010 (JP) ..... 2010-294189

(51) Int. Cl.
*G09G 3/36* (2006.01)
*G09G 3/34* (2006.01)

(52) U.S. Cl.
CPC ..... *G09G 3/36* (2013.01); *G09G 3/3648* (2013.01); *G09G 3/342* (2013.01); *G09G 3/3614* (2013.01);

(Continued)

(58) Field of Classification Search
CPC .... G09G 3/36; G09G 3/3611; G09G 3/3614; G09G 3/3644; G09G 3/3666; G09G 5/005
USPC ..... 345/87–104
See application file for complete search history.

(56) References Cited

U.S. PATENT DOCUMENTS 6,545,653 B1 * 4/2003 Takahara et al. ..... 345/87
7,916,213 B2 * 3/2011 Tomizawa ..... G09G 3/2011 348/448

(Continued)

FOREIGN PATENT DOCUMENTS

JP 2-214818 A 8/1990
JP 5-64108 A 3/1993

(Continued)

OTHER PUBLICATIONS

Kim et al, "82" Ultra Definition LCD Using New Driving Scheme and Advanced Super PVA Technology" SID Symposium Digest: 196-199. 2008.

(Continued)

*Primary Examiner* — Alexander Eisen
*Assistant Examiner* — Nelson Lam
(74) *Attorney, Agent, or Firm* — Harness, Dickey & Pierce, P.L.C.

(57) ABSTRACT

A display control circuit of a liquid crystal display device generates a double-speed progressive image signal by changing an input image signal based on interlaced scanning into a progressive scanning mode, and also by doubling the frame frequency. With the double-speed progressive image signal, a pixel value equivalent to an odd-numbered scanning line in an odd-numbered frame remains unchanged, a pixel value equivalent to an even-numbered scanning line is replaced with a black pixel value, a pixel value equivalent to an even-numbered scanning line in an even-numbered frame remains unchanged, and a pixel value equivalent to an odd-numbered scanning line is replaced with a black pixel value. An image that the double-speed interlace image signal represents is displayed on a liquid crystal panel.

16 Claims, 15 Drawing Sheets

(52) U.S. Cl.
CPC .... *G09G 3/3655* (2013.01); *G09G 2300/0426* (2013.01); *G09G 2310/024* (2013.01); *G09G 2310/0224* (2013.01); *G09G 2310/061* (2013.01); *G09G 2310/08* (2013.01); *G09G 2320/0247* (2013.01); *G09G 2320/0252* (2013.01); *G09G 2320/0261* (2013.01); *G09G 2340/16* (2013.01)

(56) References Cited

U.S. PATENT DOCUMENTS

| | | | | |
|---|---|---|---|---|
| 2005/0259064 | A1* | 11/2005 | Sugino et al. | 345/102 |
| 2006/0176262 | A1* | 8/2006 | Fujine et al. | 345/98 |
| 2006/0187343 | A1* | 8/2006 | Tomizawa | G09G 3/2011 348/448 |
| 2007/0146279 | A1* | 6/2007 | Oke et al. | 345/94 |
| 2007/0164946 | A1* | 7/2007 | Akutsu et al. | 345/87 |
| 2007/0222733 | A1* | 9/2007 | Ju et al. | 345/98 |
| 2007/0229432 | A1* | 10/2007 | Kimura | G09G 3/3614 345/96 |
| 2007/0229705 | A1* | 10/2007 | Chida et al. | 348/448 |
| 2009/0102771 | A1* | 4/2009 | Sugisawa et al. | 345/89 |
| 2009/0310017 | A1* | 12/2009 | Tomita | 348/446 |
| 2011/0134159 | A1* | 6/2011 | Adachi | 345/690 |

FOREIGN PATENT DOCUMENTS

| | | | |
|---|---|---|---|
| JP | 2002041008 | A | 2/2002 |
| JP | 2004062134 | A | 2/2004 |
| JP | 2006-106062 | A | 4/2006 |
| JP | 2010048958 | A | 3/2010 |
| JP | 2010249899 | A | 11/2010 |
| WO | WO-2007077830 | A1 | 7/2007 |

OTHER PUBLICATIONS

International Search Report PCT/ISA/210 for International Application No. PCT/JP2011/079616 Dated Jan. 24, 2012.

Written Opinion of the International Searching Authority PCT/ISA/237 for International Application No. PCT/JP2011/079616 dated Jan. 24, 2012.

* cited by examiner

DISPLAY DEVICE CONFIGURED TO PERFORM PSEUDO INTERLACE SCANNING IMAGE DISPLAY BASED ON PROGRESSIVE IMAGE SIGNAL, DRIVING METHOD THEREOF, AND DISPLAY DRIVING CIRCUIT

TECHNICAL FIELD

The present invention relates to an active-matrix-type display device such as a liquid crystal display device using a switching element such as a thin-film transistor or the like, and a driving method thereof.

BACKGROUND ART

In order to display an image on a display panel such as a liquid crystal panel having large capacitance or the like using image signals conforming to the interlaced format such as television signals, there has known a format such as a system for driving two lines of a display panel at the same time using one-line signal during each field period (called "line doubler system"). According to use of this line doubler system, an image can be displayed on a large-capacitance display panel using signals conforming to the interlaced format, but the image that an image signal thereof represents cannot be displayed in a suitable manner. Specifically, of image signals conforming to this interlaced format, in the event that signals equivalent to two lines to be driven at the same time mutually differ, not only substantial resolution of still image display deteriorates, but also an edge portion of a display image flickers or blurs. As a technique for avoiding such an inconvenience, there has heretofore been employed a technique for converting an image signal conforming to the interlaced format into an image signal according to the progressive format (this conversion is called "IP conversion") to drive the display panel one line at a time (hereinafter, referred to as IP conversion+1-line driving technique).

On the other hand, in accordance with high definition of a display image or increase in the size of a display panel, securable charge time is shortened for writing of an image signal to the display panel, and accordingly, insufficient charge in the pixel capacitance of the display panel causes a problem. As a technique for preventing this insufficient charge, a technique called pre-charging has been known. This is a technique wherein at the time of two horizontal periods (2H periods) ahead of a point-in-time when an image signal is to be written in each line in a liquid crystal panel, an active signal is applied to a gate signal line (scanning signal line) corresponding to this line, thereby preliminarily charging each pixel capacitance in this line using an image signal having the same polarity as an image signal to be written in this line (image signal to be written in pixel capacitance in a line two lines ahead).

Note that techniques relating to the present invention have been disclosed in PTL 1 and PTL 2. Specifically, with PTL 1, there has been disclosed a configuration wherein, in order to have a display device which is weak in high-speed scanning, such as a liquid crystal display device or the like, display a progressive scanning video signal with a high-speed data rate, one video screen is displayed from video signals in multiple frame periods taking into consideration the polarity of a video signal. Also, with PTL 2, there has been disclosed a liquid crystal TV driving circuit independently including a data-side driver and a scanning-side driver regarding each of an odd-line pixel group and an even-line pixel group of a liquid crystal panel, which can independently drive the odd-line pixel group and even-line pixel group at the same time. Note that, in this manner, a configuration has also been disclosed in NPL 1 wherein the odd-line pixel group and even-line pixel group are simultaneously driven.

CITATION LIST

Patent Literature

PTL 1: Japanese Unexamined Patent Application Publication No. 2002-41008

PTL 2: Japanese Unexamined Patent Application Publication No. 5-64108

Non Patent Literature

NPL 1: Sang Soo Kim et al., "82" Ultra Definition LCD Using New Driving Scheme and Advanced Super PVA Technology", SID Symposium Digest, pp. 196-199, 2008

SUMMARY OF INVENTION

Technical Problem

However, in the event that the above-mentioned IP conversion+1-line driving technique has simply been used in a liquid crystal panel for example, high moving image display performance cannot be obtained due to that hold-type display and response speed of liquid crystal are slow. Also, in the event of having employed the pre-charging technique, a charging rate that actually arrives according to pre-charging as to pixel capacitance depends on charging state and pre-charging voltage of pixel capacitance in the previous frame, and crosstalk is caused due to this. As a result thereof, there is caused a problem in that display quality deteriorates regarding not only moving images but also still images. Note that, in the event of having employed the line doubler system, charging time as to pixel capacitance can be prolonged, but as described above, there is caused a problem such that substantial resolution of still image display deteriorates, or the like.

Therefore, the present invention has an object to provide a display device from which high display performance is obtained regarding both of a moving image and a still image even if definition of display images or increase in the size of display panels advance.

Solution to Problem

A first aspect of the present invention is a display device which is an active-matrix-type display device configured to display an image using a progressive image signal which is an image signal based on progressive scanning, including: a display unit including a pixel array made up of a plurality of pixel formation units disposed in a matrix shape; and a display driving circuit configured to drive the display unit based on the progressive image signal; with the display driving circuit driving, during a frame period while image display is performed based on a first signal which is one frame signal of two adjacent frame signals included in the progressive image signal, the display unit so that images of odd-numbered scanning lines in an image that this first signal represents are formed of a pixel formation unit group in odd-numbered scanning lines in the pixel array, and also, a black display line is formed of a pixel formation unit group in even-numbered scanning lines in the pixel array; and with the display driving circuit driving, during a frame period while image display is performed based on a second signal which is the other frame signal of the two adjacent frame signals, the display unit so that images of even-numbered scanning lines in an image that this second signal represents are formed of a pixel formation unit group in even-numbered scanning lines in the pixel array, and also, a black display line is formed of a pixel formation unit group in odd-numbered scanning lines in the pixel array.

With a second aspect of the present invention, according to the first aspect of the present invention, the black display line formed of a pixel formation unit group of the even-numbered scanning lines, and the black display line formed of a pixel formation unit group of the odd-numbered scanning lines are displayed with lower luminance than 10% of the maximum luminance.

with a third aspect of the present invention, according to the first aspect of the present invention, the black display line formed of a pixel formation unit group of the even-numbered scanning lines, and the black display line formed of a pixel formation unit group of the odd-numbered scanning lines are displayed with luminance higher than 1% but lower than 10% of the maximum luminance.

With a fourth aspect of the present invention, according to the first aspect of the present invention, the display driving circuit further includes a frame frequency converter configured to generate the progressive image signal by receiving an input image signal based on progressive scanning, and changing the frame frequency of the input image signal into twice as much as thereof.

With a fifth aspect of the present invention, according to the first aspect of the present invention, that the display driving circuit further includes a signal format converter configured to generate the progressive image signal by receiving an input image signal based on interlaced scanning, and changing a scanning mode of this input image signal into a progressive scanning mode, and also changing the frame frequency of the input image signal into twice as much as thereof.

With a sixth aspect of the present invention, according to the first aspect of the present invention, the display driving circuit generates an interlace image signal by replacing, of two adjacent frames in the progressive image signal, pixel values equivalent to even-numbered scanning lines with a black pixel value in one frame, and replacing pixel values equivalent to odd-numbered scanning lines with a black pixel value in the other frame, and drives the display unit based on this interlace image signal.

With a seventh aspect of the present invention, according to the first aspect of the present invention, the display unit further includes a plurality of scanning signal lines extending in a first direction, and a plurality of data signal lines which extend in a second direction and intersect with the plurality of scanning signal lines; with the plurality of pixel formation units being disposed in a matrix shape along the plurality of data signal lines and the plurality of scanning signal lines; with each of the scanning signal lines corresponding to any one of a plurality of sets of pixel formation unit rows to be obtained by grouping the plurality of pixel formation units with two pixel formation unit rows mutually adjacent and extending in the first direction in the pixel array as one set, and also connecting to each pixel formation unit included in two pixel formation unit rows which make up the corresponding set; with each pixel formation unit row extending in the second direction in the pixel array corresponding to any one of a plurality of sets of data signal lines to be obtained by grouping the plurality of data signal lines with two adjacent data signal lines as one set, and one of two data signal lines which make up each set being connected to one of two pixel formation units to be connected to the same scanning signal line of pixel formation units included in a pixel formation unit row corresponding to this set, and the other of the two data signal lines being connected to the other of the two pixel formation units; and with the display driving circuit including a scanning signal line driving circuit configured to selectively activate the plurality of scanning signal lines, and a data signal line driving circuit configured to generate a plurality of data signals which represent an image to be displayed on the display unit based on the progressive image signal, and to apply these to the plurality of data signal lines.

With an eighth aspect of the present invention, according to the seventh aspect of the present invention, that two pixel formation units adjacent in the second direction which are mutually connected to different scanning signal lines are connected to the same data signal line.

With a ninth aspect of the present invention, according to the seventh or eighth aspect of the present invention, the data signal line driving circuit generates the plurality of data signals so that data signals having a mutually different polarity are applied to two data signal lines corresponding to each pixel formation unit row extending in the second direction in the pixel array.

With a tenth aspect of the present invention, according to the seventh or eighth aspect of the present invention, the data signal line driving circuit generates the plurality of data signals so that data signals having a mutually different polarity are applied to two data signal lines connected to two pixel formation units adjacent in the first direction in the pixel array respectively.

With an eleventh aspect of the present invention, according to the seventh or eighth aspect of the present invention, the data signal line driving circuit generates the plurality of data signals so that the polarities of data signals to be applied to the plurality of pixel formation units via the plurality of data signal lines invert for each even frame period.

With a twelfth aspect of the present invention, according to the first aspect of the present invention, the data display driving circuit obtains an image signal where temporal change in the progressive image signal is enhanced by comparing a signal value of the current frame in the progressive image signal with a signal value two frames ahead, as an enhanced image signal, and drives the display unit based on this enhanced image signal.

With a thirteenth aspect of the present invention, according to the twelfth aspect of the present invention, the display driving circuit includes first and second frame memory configured to delay the progressive image signal by two frame periods, and an enhancement conversion unit configured to obtain the enhanced image signal by comparing a signal value of the current frame in the progressive image signal with a signal value two frames ahead obtained by the first and second frame memory; with the display driving circuit obtaining the signal value two frame ahead in the progressive image signal by sequentially performing writing to the first frame memory and readout from the first frame memory of a signal value from which a signal value corresponding to a pixel which makes up the black display line from a signal value that the progressive image signal indicates has been excluded, and writing to the second frame memory and readout from the second frame memory of the signal value readout from the first frame memory.

With a fourteenth aspect of the present invention, according to the first aspect of the present invention, the display device further includes: a planar lighting device configured to irradiate light on the rear face of the display unit; and a backlight driving circuit configured to turn on and turn off the planar lighting device in increments of predetermined areas corresponding to a predetermined number of scanning lines in conjunction with scanning for displaying the image using the display unit based on the progressive image signal; with the display unit being a liquid crystal panel configured to display the image by controlling transmittance of light from the planar lighting device according to driving voltage to be given to each pixel formation unit based on the progressive image signal; and with the backlight driving circuit turning on and turning off the planar lighting device in increments of the predetermined areas so that of each frame period for forming a pixel of the image using each pixel formation unit, light is not irradiated on this pixel formation unit from the planar lighting device by a predetermined period.

With a fifteenth aspect of the present invention, according to the fourteenth aspect of the present invention, the backlight driving circuit turns on and turns off the planar lighting device in increments of the predetermined areas so that the predetermined period is equal to or greater than ½ of one frame period.

With a sixteenth aspect of the present invention, according to the fourteenth aspect of the present invention, the backlight driving circuit includes a plurality of low-pass filters corresponding to the number of the predetermined areas in the planar lighting device; with the backlight driving circuit giving a plurality of driving signals for turning on and turning off each of the predetermined areas in the planar lighting device to the planar lighting device via the plurality of low-pass filters respectively.

With a seventeenth aspect of the present invention, according to the fourteenth aspect of the present invention, the backlight driving circuit turns on and turns off the planar lighting device in increments of the predetermined areas so as that light is irradiated, by a predetermined period including before and after a start point-in-time of each frame for each pixel formation unit forming a pixel which makes up the black display line, on this pixel formation unit from the planar lighting device.

With an eighteenth aspect of the present invention, according to the fourteenth aspect of the present invention, the planar lighting device includes a plurality of light-emitting diodes as light sources.

With a nineteenth aspect of the present invention, according to the first aspect of the present invention, that the display unit is a liquid crystal panel conforming to the VA system.

Other aspects according to the present application are apparent from the first to nineteenth aspects and description relating to later-described embodiments, and accordingly, description thereof will be omitted.

Advantageous Effects of Invention

According to the first aspect of the present invention, with the pixel formation units, a display frame period which is a frame period for forming a pixel of an image to be displayed, and a black frame period which is a frame period for forming a black pixel alternately appear (black insertion for interlace is performed), and accordingly, even when optical response of each pixel formation unit is slow, video crosstalk from the previous frame is suppressed. Also, an arrangement is made wherein black display lines are formed every other scanning line in the pixel array by black insertion for interlace, and accordingly, occurrence of flickers can be prevented without increasing the frame frequency. Also, of two adjacent frames, with one of the frames, black insertion is performed on odd-numbered scanning lines, and with the other frame, black insertion is performed on even-numbered scanning lines, and accordingly, in the event of displaying a still image, a high-definition image is configured of images of two adjacent frames, and resolution does not deteriorate due to the black insertion for interlace. Accordingly, high display performance is obtained regarding both of moving images and still images even if definition of display images or increase in the size of display panels advance. Note that, in the event that the display device according to the first aspect of the present invention is a liquid crystal display device, insufficient charging of pixel capacitance at each pixel formation unit is prevented by the black insertion for interlace, and accordingly, this point also contributes to suitable display of a high-definition moving image.

According to the second aspect of the present invention, a black display line in the black insertion for interlace is displayed with lower luminance than 10% of the maximum luminance, and accordingly, with a display image, a sufficient contrast ratio is obtained with frame period averaging.

According to the third aspect of the present invention, a black display line in the black insertion for interlace is displayed with luminance higher than 1% but lower than 10% of the maximum luminance, and accordingly, with a display image, a sufficient contrast ratio is obtained with frame period averaging. Also, in the event that a display device according to the third aspect of the present invention is a liquid crystal display device, the black display line is displayed with higher luminance than 1% of the maximum luminance, an accordingly, at the time of formation of the black display line thereof as well, voltage is applied to liquid crystal so that liquid crystal molecules have a predetermined tilt angle as to a substrate surface of a liquid crystal panel, and accordingly, deterioration in optical responsiveness of liquid crystal in interlace display due to black insertion can be suppressed.

According to the fourth aspect of the present invention, an image is displayed on the display unit based on a progressive image signal having twice as much as the frame frequency of an input image, and accordingly, high moving image display performance is obtained.

According to the fifth aspect of the present invention, an image is displayed on the display unit based on a progressive image signal to be obtained by changing an input image signal based on interlaced scanning into the progressive scanning, and also changing the frame frequency into twice as much as thereof, and accordingly, even when an input image signal based on interlaced scanning is externally given, high moving image display performance is obtained.

According to the sixth aspect of the present invention, an interlace image signal is generated from a progressive image signal, and an image is displayed on the display unit based on this interlace image signal, and accordingly, the same advantage as with the first aspect of the present invention is obtained.

According to the seventh aspect of the present invention, two pixel formation unit rows (two horizontal pixel formation unit rows) extending in the first direction is driven by one scanning signal line at the same time, a data signal is given to the pixel formation units via two data signal lines per one vertical pixel formation unit row, and accordingly, it takes twice as much as a case of using only one data signal line for writing a data signal in the pixel formation units as a pixel value. Accordingly, in the event that a display device according to the seventh aspect of the present invention is a liquid crystal display device, twice as much as usual charging time can be secured, and accordingly, even if increase in definition of display images or increase in the size of liquid crystal panels advance, and also, even if increase in driving speed of liquid crystal panels advances to improve moving image performance, insufficient charging for pixel capacitance at the pixel formation units can be prevented.

According to the eighth aspect of the present invention, two pixel formation units which are connected to mutually different scanning signal lines and adjacent in the second direction (vertical direction) are connected to the same data signal line, and accordingly, in the same way as with the seventh aspect of the present invention, what is called 2H inversion driving can be performed while securing sufficient time for writing a data signal in the pixel formation units as a pixel value. Accordingly, in the event that a display device according to the eighth aspect of the present invention is a liquid crystal display device, even when a black display line in a display image of black insertion for interlace is excluded, the polarity of pixel voltage is inverted in the vertical direction for each pixel formation unit, and accordingly, occurrence of flickers due to alternating current driving of the liquid crystal can be prevented in a surer manner.

According to the ninth aspect of the present invention, data signals having a mutually different polarity are applied to two data signal lines corresponding to the pixel formation unit rows (the vertical pixel formation unit rows) extending in the second direction in the pixel array, and accordingly, a pixel formation unit to which a data signal having a positive polarity is given, and a pixel formation unit to which a data signal having a negative polarity is given are alternately arrayed in the second direction (vertical direction). Thus, in the event that a display device according to the ninth aspect of the present invention is a liquid crystal display device, occurrence of flickers due to alternating current driving of the liquid crystal can be prevented.

According to the tenth aspect of the present invention, data signals having a mutually different polarity are applied to two data signal lines each connected to two pixel formation units adjacent in the first direction (horizontal direction) in the pixel array, and accordingly, a pixel formation unit to which a data signal having a positive polarity is given, and a pixel formation unit to which a data signal having a negative polarity is given are alternately arrayed in the first direction (horizontal direction). Thus, in the event that a display device according to the tenth aspect of the present invention is a liquid crystal display device, occurrence of flickers due to alternating current driving of the liquid crystal can be prevented.

According to the eleventh aspect of the present invention, the polarity of a data signal to be given to the pixel formation units via a data signal line is inverted for each even frame period, and accordingly, alternating current driving can be performed while performing black insertion for interlace. Thus, in the event that a display device according to the eleventh aspect of the present invention is a liquid crystal display device, deterioration in liquid crystal can be prevented.

According to the twelfth aspect of the present invention, the display unit is driven (OS driving is performed) based on an enhanced image signal to be obtained by comparing a signal value of the current frame in the progressive image signal with a signal value two frames ahead on the premise of interlace display according to black insertion. Thus, optical responsiveness of the display unit can be improved and moving image display performance can be improved without necessity for a complicated circuit.

According to the thirteenth aspect of the present invention, of signal values that the progressive image signal indicates, a signal value corresponding to a pixel which makes up a black display line is not stored in the first and second frame memory, and accordingly, memory amount necessary for obtaining an enhanced image signal is reduced by comparing a signal value of the current frame in the progressive image signal with a signal value two frames ahead.

According to the fourteenth aspect of the present invention, of the frame periods for forming a pixel of an image to be displayed by each pixel formation unit, turning on and turning off of the planar lighting device are controlled in increments of predetermined areas so that light is not irradiated on this pixel formation unit from the planer lighting device only for a predetermined period. Thus, conversion into impulses according to black insertion is stabilized, and moving imager display performance is further improved without increasing the frame frequency.

According to the fifteenth aspect of the present invention, of the frame periods for forming a pixel of an image to be displayed by each pixel formation unit, a predetermined period while light is not irradiated on the pixel formation unit from the planar lighting device is to or greater than ½ of one frame period, and accordingly, a sufficient impulse conversion effect is obtained.

According to the sixteenth aspect of the present invention, multiple driving signals for turning on and turning off predetermined areas in the planar lighting device are given to the planer lighting device via multiple low-pass filters respectively, and accordingly, the amount of irradiation light to the liquid crystal panel serving as the display unit does not extremely fluctuate between the predetermined areas. Thus, deterioration in display quality due to block separation or the like is suppressed.

According to the seventeenth aspect of the present invention, turning on and off of the planar lighting device are controlled in increments of predetermined areas so that light is irradiated on this pixel formation unit from the planar lighting device by a predetermined period including before and after a start point-in-time of each frame for each pixel formation unit forming a pixel which makes up a black display line. Thus, during a transitional period since voltage corresponding to desired luminance (the value of a pixel to be formed) was applied to a pixel formation unit until the luminance of a pixel to be formed by this pixel formation unit reaches this desired luminance, no light is irradiated on this pixel formation unit. Therefore, the impulse conversion effect is more stabilized, crosstalk between frames is eliminated in a sure manner, and moving image display performance further improves.

According to the eighteenth aspect of the present invention, a light-emitting diode is employed as a light source of the planar lighting device, and accordingly, turning on and off of the planar lighting device can be controlled in increments of predetermined areas with excellent precision.

According to the nineteenth aspect of the present invention, a liquid crystal panel of the VA system is employed as the display unit, and accordingly, optical responsiveness of liquid crystal in a frame for displaying a black pixel (black frame) is relatively fast, more stable driving can be performed, and also, the contrast ratio is basically high, and adjustment of gradation is facilitated.

DESCRIPTION OF EMBODIMENTS

Hereinafter, embodiments of the present invention will be described with reference to the appended diagrams.

1. First Embodiment

1.1 Whole Configuration

Figure 1:
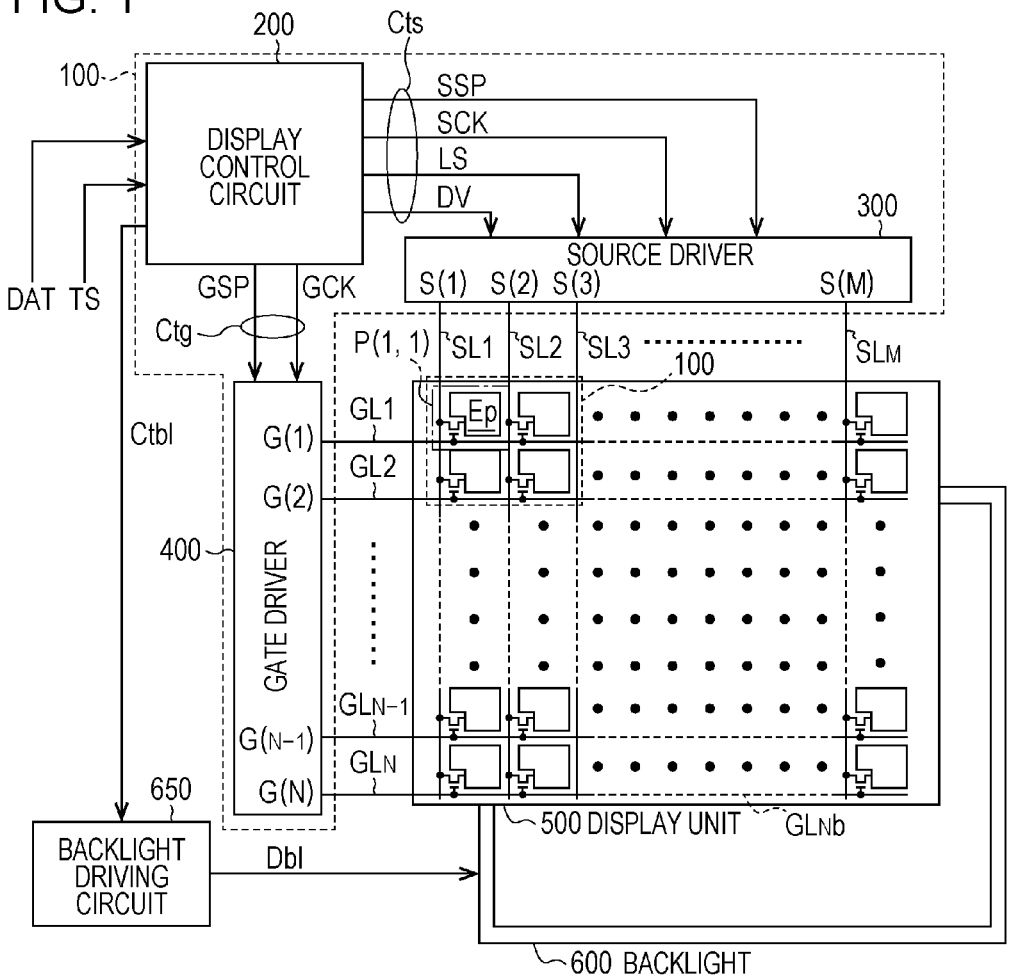
FIG. 1 is a block diagram illustrating a configuration of a liquid crystal display device according to a first embodiment of the present invention.

FIG. 1 is a block diagram illustrating a configuration of an active-matrix-type liquid crystal device according to a first embodiment of the present invention. This liquid crystal device includes a display unit 500 which is a liquid crystal panel conforming to the normally black mode, a display driving circuit 100 configured to drive the display unit 500 thereof, a backlight 600 serving as a planar lighting device configured to irradiate light on the rear face of the display unit 500 (liquid crystal panel), and a backlight driving circuit 650 configured to drive the backlight 600 thereof. The display driving circuit 100 includes a source driver 300 serving as a data signal line driving circuit, a gate driver 400 serving as a scanning signal line driving circuit, and a display control circuit 200, and this display control circuit 200 controls the source driver 300, gate driver 400, and backlight driving circuit 650. An image signal DAT and a timing control signal TS configured to display an image are input to the display control circuit 200 from outside the device. multiple data signal lines SL1 to SLM connected to the source driver 300, and multiple scanning signal lines GL1 to GLN connected to the gate driver 400 are included in the display unit 500, and the multiple data signal lines SL1 to SLM and the scanning signal lines GL1 to GLN are disposed so as to be mutually crossed. Also, a pixel array made up of multiple pixel formation units P(i, j) disposed in a matrix shape along the multiple data signal lines SL1 to SLM and multiple scanning signal lines GL1 to GLN is included in the display unit 500 (i=1 to N, j=1 to M).

Note that, with the present embodiment, the source driver 300 and gate driver 400 are realized as an IC (Integrated Circuit) which a component apart from the liquid crystal panel serving as the display unit 500. However, instead of this, a driver monolithic type panel may be employed as the liquid crystal panel. Specifically, the display unit 500 and at least one of the gate driver 400 and source driver 300 may integrally be formed on the liquid crystal panel using a thin-film transistor or the like.

Figure 3:
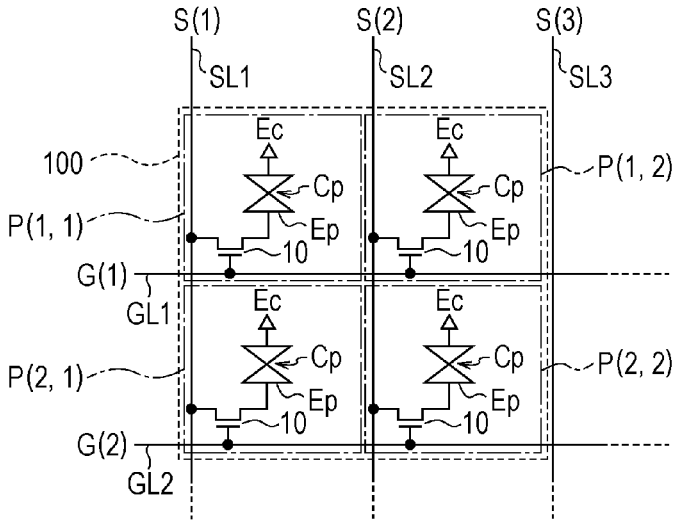
FIG. 3 is a circuit diagram illustrating an equivalent circuit of a pixel formation unit (equivalent to four pixels) in the first embodiment.

FIG. 3 is a circuit diagram illustrating an equivalent circuit of the pixel formation units (i, j) in the display unit 500. The pixel formation units P(i, j) include a pixel electrode Ep, and a thin-film transistor (hereinafter, abbreviated as "TFT") 10 serving as a switching element. Now, as illustrated in FIG. 1 and FIG. 3, let us say that the reference numeral "P(i, j)" indicates a pixel formation unit in the i'th row and j'th column of the pixel array made up of pixel formation units disposed in a matrix shape in the display unit 500, that is, a pixel formation unit included in both of the i'th pixel formation unit row arrayed in a first direction which is a direction where the scanning signal line GLi extends (hereinafter, referred to as "horizontal direction"), and the j'th pixel formation unit row arrayed in a second direction which is a direction where the data signal line SLj line extends (hereinafter, referred to as "vertical direction"). The i'th scanning signal line GLi and j'th data signal line SLj are connected to the gate terminal and source terminal of the TFT 10 in each of the sub pixel formation units P(i, j) respectively, and the pixel electrode Ep is connected to the drain terminal of this TFT 10. Hereinafter, let us say that the TFT 10 goes to an on state when a scanning signal G(i) to be given to the gate terminal thereof is in a high level (H level), and goes to an off state when the gate terminal thereof is in a low level (L level). Also, with the display unit 500, a shared electrode Ec is mutually provided to all of the pixel formation units P(i, j) (i=1 to N, j=1 to M), and the pixel electrode Ep in each pixel formation unit (i, j) faces the shared electrode Ec via a liquid crystal layer, and pixel capacitance Cp is formed of the pixel electrode Ep and shared electrode Ec. This pixel capacitance Cp is configured to hold voltage equivalent to the value of a pixel to be formed by this pixel formation unit P(i, j). Note that predetermined voltage is given to the shared electrode Ec by a shared electrode driving circuit (not illustrated) as shared voltage Vcom.

Figure 2:
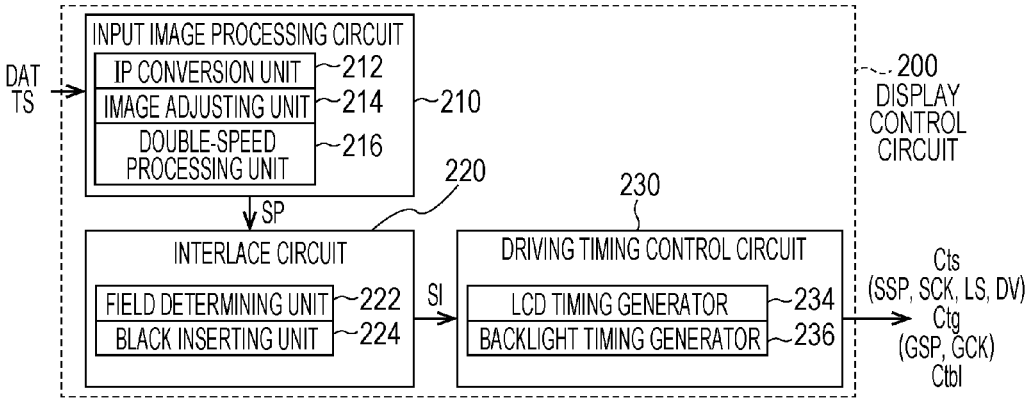
FIG. 2 is a block diagram illustrating a configuration of a display control circuit in the first embodiment.

FIG. 2 is a block diagram illustrating the configuration of the display control circuit 200. The display control circuit 200 includes an input image processing circuit 210, an interlace circuit 220, and a driving timing control circuit 230.

The display control circuit 200 externally receives an image signal (hereinafter, the format of this image signal will be referred to as "1920×1080@601") DAT conforming to the interlaced scanning compatible with high-definition television (HDTV: High Definition Television) wherein the number of scanning lines is 1080, the number of pixels is 1920×1080, and the field frequency is 60 Hz, along with the timing signal TS. These signals DAT and TS are given to the input image processing circuit 210. Note that, with the present embodiment, let us say that an image signal compatible with HDTV is externally input to the display control circuit 200 as the image signal DAT in this manner, but the present invention is not restricted to this.

The input image processing circuit 210 serves as a signal format converter, includes an IP conversion unit 212, an image adjusting unit 214, and a double-speed processing unit 216, and the externally input image signal DAT conforming to the interlaced scanning is input to the IP conversion unit 212. The IP conversion unit 212 converts this image signal DAT conforming to interlaced scanning into an image signal conforming to the progressive scanning mode (such conversion is called "IP conversion"). Thus, an image signal conforming to the progressive scanning mode wherein the number of pixels is 1920×1080, and the frame frequency is 60 Hz (hereinafter, the format of this image signal will be referred to as "1920×1080@60P") is obtained, this image signal conforming to the progressive scanning mode is input to the image adjusting unit 214. The image adjusting unit 214 subjects the image signal confirming to the progressive scanning mode to processing for adjusting a display image in accordance with the property and use purpose of the present liquid crystal display device (image adjustment) according to need. This image signal subjected to image adjustment according to need is input to the double-speed processing unit 216 serving as a frame frequency converter (hereinafter, abbreviated as "FRC"), and the double-speed processing unit 216 changes the frame frequency of this image signal into twice as much as the original frame frequency thereof. Thus, an image signal conforming to the progressive scanning mode wherein the number of pixels is 1920×1080, and the frame frequency is 120 Hz, that is, an image signal (hereinafter, referred to as "double-speed progressive image signal") SP of 1920×1080@120P is obtained. This double-speed progressive image signal SP is output from the input image processing circuit 210 to the interlace circuit 220.

The interlace circuit 220 includes a field determining unit 222 and a black inserting unit 224, and the double-speed progressive image signal SP from the input image processing circuit 210 is input to the field determining unit 222. The field determining unit 222 determines a field type for later-described double-speed interlace display. Specifically, the field determining unit 222 determines whether the current frame of the double-speed progressive image signal SP corresponds to the previous frame or subsequent frame in later-described double-speed interlace display. With later-described double-speed interlace display, two adjacent frames are grouped as one set, and one screen worth of image is displayed regarding each set by interlaced scanning (see FIG. 5 and FIG. 7). Therefore, the field determining unit 222 identifies whether the current frame is an odd-numbered frame or even-numbered frame, and in the event of an odd-numbered frame, determines that the current frame corresponds to the previous frame (frame corresponding to an odd field), and in the event of an even-numbered frame, determines that the current frame corresponds to the subsequent frame (frame corresponding to an even field), but instead of this, an arrangement may be made wherein in the event of an even-numbered frame, determination is made that the current frame corresponds to the previous frame, and in the event of an odd-numbered frame, determination is made that the current frame corresponds to the subsequent frame. In order to identify whether the current frame is an odd-numbered frame or even-numbered frame, vertical synchronizing signals of the double-speed progressive of the progressive image signal SP have to be counted, or information for identification thereof has to be received from the FRC within the input image processing circuit 210. At the time of counting the vertical synchronizing signals, even/odd frames have to be determined, and accordingly, all that is necessary is that a 1-bit flag is inverted for each vertical synchronizing signal.

After the determination is performed at the field determining unit 222, the double-speed progressive image signal SP is input to the black inserting unit 224, and in the event that the current frame is an odd-numbered frame, the black inserting unit 224 leaves, of the double-speed progressive image signal SP thereof, a pixel value equivalent to an odd-numbered scanning line of the current frame as it is, and replaces a pixel value equivalent to an even-numbered scanning line of the current frame with a black pixel value (gradation value for black display). On the other hand, in the event that the current frame is an even-numbered frame, the black inserting unit 224 leaves, of the double-speed progressive image signal SP thereof, a pixel value which makes up an even-numbered scanning line of the current frame as it is, and replaces a pixel value equivalent to an odd-numbered scanning line of the current frame with a black pixel value (hereinafter, black insertion according to such replacement with a black pixel value will be referred to as "black insertion for interlace"). Note that the scanning line mentioned here means a display line to be formed with pixel formation unit rows arrayed in the horizontal direction. According to such processing at the black inserting unit 224, an image signal (hereinafter, referred to as "double-speed interlace image signal") SI compatible with later-described double-speed interlace display (see FIG. 5 and FIG. 7) is obtained. This double-speed interlace image signal SI is input to the driving timing control circuit 230.

Note that the above-mentioned black pixel value for black insertion for interlace is not necessarily restricted to a gradation value 0 equivalent to the minimum luminance. As the above-mentioned black pixel value for black insertion for interlace, it is desirable to employ a fixed gradation value equivalent to luminance within a range of 1% to 10% of the maximum luminance. Hereinafter, description will be made regarding this point.

The inventor of the present application investigated a contrast ratio to be obtained by changing the gradation value of black display at the liquid crystal display device, under room temperature, when holding voltage equivalent to luminance of 10% of the maximum luminance at the pixel capacitance Cp of a pixel formation unit to be displayed with black, a contrast ratio equal to or greater than 300 with frame averaging was found to be obtained. This can be thought to be due to that, with actual image display, gradation of each pixel is repeatedly changed between gradation of an image to be displayed and gradation of black display, and accordingly, based on response of liquid crystal as to such change, a contrast ratio with frame period averaging becomes greater than a contrast ratio (1/0.1=10) corresponding to the above-mentioned "luminance of 10%". On the other hand, with a liquid crystal display device conforming to a mode using perpendicular orientation/oblique electric field which has spread most, response of the liquid crystal when changing applied voltage to the liquid crystal (voltage held at the pixel capacitance Cp) from voltage equivalent to true black (gradation value 0) is very slow, and this response is not improved even when employing a driving method for enhancing temporal change in gradation (a diving method called "overshoot driving or OS driving"). As a method for improving this response, there has been known a mode wherein voltage is applied to liquid crystal beforehand so that liquid crystal molecules have a predetermined tilt angle as to a substrate surface of a liquid crystal panel. However, a defect has been pointed out wherein when employing this mode, contrast deteriorates due to leakage of light in a black display area of the liquid crystal panel. On the other hand, the inventor of the present application investigated a contrast ratio by holding voltage equivalent to luminance of 1% of the maximum luminance at the pixel capacitance Cp of a pixel formation unit to be displayed with black so as to secure a predetermined tilt angle, with actual image display, gradation of each pixel is repeatedly changed between gradation of an image to be displayed and gradation of black display, and accordingly, a contrast ratio of 500 or more exceeding (1/0.01=100) with frame period averaging was obtained. Accordingly, in the event of applying voltage equivalent to a fixed gradation value indicating luminance within a range of 1% to 10% of the maximum luminance the liquid crystal of a pixel formation unit to be displayed with black, practical sufficient performance can be obtained regarding the above-mentioned response and contrast.

The driving timing control circuit 230 includes an LCD timing generator 234 and a backlight timing generator 236, and generates a control signal indicating timing for displaying an image that the above-mentioned interlace image signal SI represents on the display unit 500. Specifically, the LCD timing generator 234 generates a data start pulse signal SSP, a data clock signal SCK, a latch signal LS, and so forth as timing signals to be given to the source driver 300, and outputs source driver control signals Cts made up of these timing signals and an image signal DV which is a signal obtained by synchronizing the above-mentioned image signal SI with these timing signals. Also, the LCD timing generator 234 generates a gate start pulse signal GSP and a gate clock signal GCK and so forth as timing signals to be given to the gate driver 400, and outputs these as gate driver control signals Ctg. On the other hand, the backlight timing generator 236 generates a control signal to be given to the backlight driving circuit 650, and outputs this as a backlight driving control signal Ctbl.

The backlight driving circuit 650 generates a backlight driving signal Dbl based on the backlight driving control signal Ctbl, and drives the backlight 600 using this backlight driving signal Dbl. Thus, the backlight 600 operates as a planar lighting device, and irradiates light on the rear face of the display unit 500 which is a liquid crystal panel.

The gate driver 400 generates scanning signals G(1) to G(N) based on the above-mentioned gate driver control signals Ctg (GSP, GCK), and applies these on the scanning signal lines GL1 to GLN of the display unit 500 respectively. Thus, the scanning signal lines GL1 to GLN are sequentially activated with one frame period as a cycle (a high-level signal is sequentially applied).

The source driver 300 generates data signals S(1) to S(M) based on the above-mentioned source driver control signals Cts (SSP, SCK, LS, DV), and applies these on the data signal lines SL1 to SLM of the display unit 500 respectively.

In this manner, with the display unit 500, the scanning signals G(1) to G(N) are applied to the scanning signal lines GL1 to GLN, and also, the data signals S(1) to S(M) are applied to the data signal lines SL1 to SLM. Thus, voltage according to an image that the image signal DV represents is applied to the liquid crystal in the pixel formation units P(i, j), and accordingly, transmittance of light from the backlight 600 is controlled, and the image that the image signal DV represents is displayed on the display unit 500.

1.2 Operation

Next, operation of the liquid crystal display device according to the present embodiment will be described.

Figure 4:
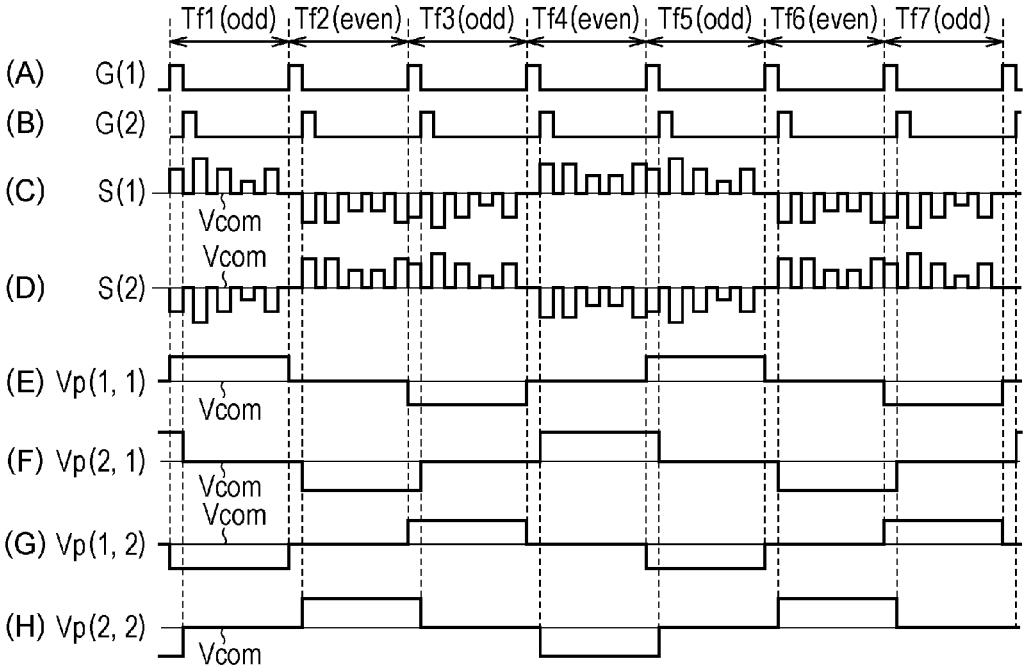
FIG. 4 is a signal waveform diagram (A to H) for describing operation of the liquid crystal display device according to the first embodiment.
Figure 5:
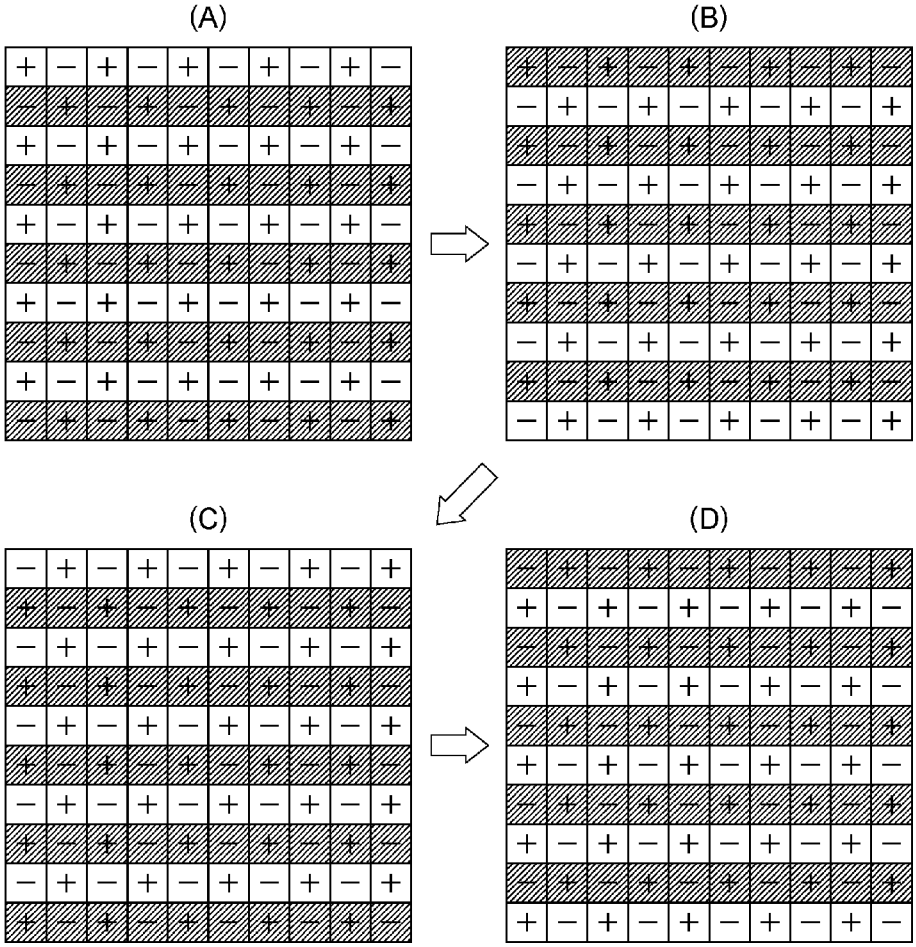
FIG. 5 is a schematic diagram (A to D) illustrating a pixel voltage polarity pattern and a pattern of black insertion for interlace in screen display by the first embodiment.

FIG. 4 is a timing chart illustrating operation of the liquid crystal device according to the present embodiment illustrated in FIG. 1. FIG. 5 is a schematic diagram illustrating a pixel voltage polarity pattern and a pattern of black insertion for interlace in screen display by the present embodiment. Hereinafter, operation of the liquid crystal display device according to the present embodiment will be described with reference to FIG. 4 and FIG. 5. Note that, with FIG. 4 and FIG. 5, for convenience of drawing, the number of pixels in the horizontal direction (=data signal line count M) and the number of pixels in the vertical direction (=scanning signal line count N) are both set to 10. Also, with the liquid crystal display device according to the present embodiment, the normally black mode has been employed, and accordingly, when voltage to be applied to the liquid crystal (held voltage at the pixel capacitance Cp) has a value approximate to 0, that is, when voltage Vp(i, j) to be applied to the pixel electrode Ep (pixel voltage) is generally equal to the shared voltage, black display is performed.

An H-level signal is, as illustrated in (A) and (B) in FIG. 4, sequentially applied to the scanning signal lines GL1 to GLN in the display unit 500 as the scanning signals G(1) to G(N), and thus, the scanning signal lines GL1 to GLN sequentially go into an activated state. With pixel formation units P(ia, j) (j=1 to M) connected to the scanning signal line GLia in an activated state, that is, with the pixel formation unit row in the ia'th scanning line, the TFT 10 goes into an on state. On the other hand, the data signals S(1) to S(M) as illustrated in (C) and (D) in FIG. 4 are applied to the data signal lines SL1 to SLM in the display unit 500. These data signals S(1) to S(M) are configured so that in order to prevent deterioration in liquid crystal at the display unit 500, this liquid is subjected to alternating current driving. With the present embodiment, what is called a dot inversion driving system is employed as this alternating current driving system, and the polarities of these data signals S(1) to S(M) are inverted for each data signal line and also inverted for each horizontal period with the shared voltage Vcom as a reference. However, according to the already-described processing at the black inserting unit 224 of the interlace circuit 220, a signal equivalent to a black pixel value (black signal) is inserted every other horizontal period (1H period), and accordingly, it can be conceived that the polarities of the data signals S(1) to S(M) are substantially not inverted within the same frame period ((C) and (D) in FIG. 4).

According to application of the scanning signals G(1) to G(N) to the scanning signal lines GL1 to GLN as described above, and application of the data signals S(1) to S(M) to the data signal lines SL1 to SLM, the display unit 500 is driven, an image is formed as follows in the pixel array of the display unit 500 (including black display lines). Specifically, with odd-numbered frame period Tfk (k=1, 3, 5, . . . ) where an image has to be displayed based on the first signal which is a signal portion of an odd-numbered frame of the double-speed progressive image signal SP generated at the input image processing circuit 210 within the display control circuit 200, an image of an odd-numbered scanning line in the image that this first signal represents is formed of a pixel formation unit group P(iod, 1) to P(iod, M) (iod=1, 3, 5, . . . ) of an odd-numbered scanning line in the pixel array of the display unit 500, and also, a black display line is formed of a pixel formation unit group P(iev, 1) to P(iev, M) (iev=2, 4, 6, . . . ) of an even-numbered scanning line in this pixel array ((A) and (C) in FIG. 5). Also, with even-numbered frame period Tfk (k=2, 4, 6, . . . ) where an image has to be displayed based on the second signal which is a signal portion of an even-numbered frame of the double-speed progressive image signal SP, an image of an even-numbered scanning line in the image that this second signal represents is formed of a pixel formation unit group P(iev, 1) to P(iev, M) (iev=2, 4, 6, . . . ) of an even-numbered scanning line in the pixel array of the display unit 500, and also, a black display line is formed of a pixel formation unit group P(iod, 1) to P(iod, M) (iod=1, 3, 5, . . . ) of an odd-numbered scanning line in this pixel array ((B) and (D) in FIG. 5).

Specifically, according to application of the scanning signals G(1) to G(N) to the scanning signal lines GL1 to GLN as described above, and application of the data signals S(1) to S(M) to the data signal lines SL1 to SLM, voltage applied to the pixel liquid crystal of the pixel formation units P(i, j), that is, voltage of the pixel electrode Ep (hereinafter, referred to as "pixel voltage Vp(i, j)") of each of the pixel formation units P(i, j) with the shared voltage Vcom as a reference changes, as illustrated in (E) to (H) in FIG. 4, in order of positive voltage→black voltage→negative voltage→black voltage with one frame period (1/120 seconds) interval, and in a macroscopic manner, periodically changes with four frame periods as one cycle (here, "black voltage" means applied voltage equivalent to a gradation value for black display. This is true in the following). Accordingly, the polarity of applied voltage to the pixel liquid crystal is inverted for each 2-frame period. For example, when focusing attention on the first frame period Tf1 to the fourth frame period Tf4 illustrated in FIG. 4, pixel voltage Vp(1, 1) illustrated in (E) in FIG. 4 changes from positive voltage→black voltage→negative voltage→black voltage with the shared voltage Vcom as a reference, pixel voltage Vp(2, 1) illustrated in (F) in FIG. 4 changes from black voltage→negative voltage→black voltage→positive voltage with the shared voltage Vcom as a reference, pixel voltage Vp(1, 2) illustrated in (G) in FIG. 4 changes from negative voltage→black voltage→positive voltage→black voltage with the shared voltage Vcom as a reference, and pixel voltage Vp(2, 2) illustrated in (H) in FIG. 4 changes from black voltage→positive voltage→black voltage→negative voltage with the shared voltage Vcom as a reference. Note that, with the present embodiment, the polarity of applied voltage to each pixel liquid crystal (polarity of pixel voltage) is inverted for each 2-frame period in this manner, but may be inverted for each even frame period equal to or longer than a 4-frame period.

The pixel voltages Vp(i, j) change as described above, and accordingly, pixel voltage polarity and black insertion for interlace in the display screen go into a pattern as illustrated in FIG. 5. This illustrates display according to double-speed interlaced scanning where two adjacent frames are configured of one screen worth of display image (referred to as "double-speed interlace display"). That is to say, with the present embodiment, display is made so that an image of one screen is configured of two adjacent frames using the interlace image signal SI (FIG. 2) obtained by doubling the frame frequency of an image signal conforming to the progressive scanning mode, and then subjecting this to interlace by black insertion. Here, (A) to (D) in FIG. 5 illustrate a pixel voltage polarity pattern and a pattern of black insertion for interlace in screen display at the end time points of the first to fourth frame periods Tf1 to Tf4, respectively. Change in these patterns illustrated in (A) to (D) in FIG. 5 is repeated with four frame periods as one cycle (see (E) to (H) in FIG. 4). As can be understood from (A) to (D) in FIG. 5, with the present embodiment, the polarities of the pixel voltages Vp(i, j), that is, polarity of applied voltage to the pixel liquid crystal is inverted for each pixel in the horizontal direction and vertical direction (this means what is called a dot inversion driving system), black insertion for interlace is performed on an even-numbered scanning line during an odd-numbered frame period, and is performed on an odd-numbered scanning line during an even-numbered frame period. Note that, with double-speed interlace display according to the present embodiment, an odd-numbered frame is taken as the previous frame, and an even-numbered frame is taken as the subsequent frame, but an arrangement may be made wherein an even-numbered frame is taken as the previous frame, and an odd-numbered frame is taken as the subsequent frame.

1.3 Advantages

With a normal liquid crystal device, immediately before voltage corresponding to a pixel value of a display image is applied to pixel capacitance (pixel liquid crystal), the pixel capacitance thereof has been charged with voltage having a polarity opposite of the polarity of voltage to be applied. On the other hand, with the present embodiment, voltage to be applied to the pixel capacities Cp, that is, the pixel voltages Vp(i, j) with the shared voltage Vcom as a reference change in order of positive voltage→black voltage→negative voltage→black voltage in one frame period intervals, and during a frame period immediately before a frame period while positive voltage or negative voltage corresponding to a pixel value of an image to be displayed is applied to the pixel capacitance Cp, black voltage has been applied to the pixel capacitance Cp ((E) to (H) in FIG. 4). Therefore, moving charge amount for charging or discharging of the pixel capacitance Cp when writing a pixel value of an image to be displayed in the display unit 500 which is a liquid crystal panel is significantly reduced than the related art (reduced to generally a half). Accordingly, even if increase in definition of display images or increase in the size of liquid crystal panels advance, and also, even if increase in driving speed of liquid crystal panels advances to improve moving image performance advances, insufficient charging for pixel capacitance can be prevented.

With the present embodiment, the image signal DAT conforming to the interlaced scanning mode wherein the field frequency is 60 Hz is converted into the double-speed progressive image signal SP which is an image signal conforming to the progressive scanning mode wherein the frame frequency is 120 Hz, and an image is displayed based on the double-speed progressive image signal SP thereof (FIG. 2). In this manner, even when displaying an image based on an image signal where the frame frequency has been changed to twice as much as the original frame frequency thereof, insufficient charging of pixel capacitance is prevented by the above-mentioned configuration, that is, configuration for double-speed interlace display, and accordingly, a moving image with high definition can suitably be displayed.

Also, with liquid crystal devices, slow response of liquid crystal may cause an image of the previous frame to be affected on image display at the current frame (hereinafter, referred to as "video crosstalk from the previous frame"), and may cause voltage change in the data signal line (source line) SLj to be affected on held voltage or pixel voltage Vp(i, j) of the pixel capacitance Cp via parasitic capacitance (hereinafter, referred to as "video crosstalk due to source capacitance coupling"), but according to the present embodiment, the crosstalk can be suppressed or reduced. Specifically, with the present embodiment, as described above, the pixel voltages Vp(i, j) change in order of positive voltage→black voltage→negative voltage→black voltage with one frame period interval ((E) and (F) in FIG. 4), and accordingly, video crosstalk from the previous frame can be suppressed. Also, with the present embodiment, the data signal lines SL1 to SLM are driven (FIG. 5) so that a black display line is formed every other scanning line in the pixel array by black insertion for interlace, and accordingly, even when dot inversion driving (in general, driving wherein the polarity of the pixel voltage Vp(i, j) is inverted in the vertical direction for each pixel) is performed, the voltage polarity of the data signal line SLj, that is, the polarity of the data signal S(j) does not substantially change within each frame period ((C) and (D) in FIG. 4), and accordingly, crosstalk due to the above-mentioned source capacitance coupling can be reduced. Also, crosstalk due to source capacitance coupling as to a black insertion line for interlace does not change at a voltage level from a liquid crystal device according to the related art, but is equal to or smaller than 10% of the maximum luminance at a luminance level, and accordingly, influence of crosstalk in a display image can be suppressed.

Also, in the event of having performed black insertion for conversion into impulses at the liquid crystal display device, it is necessary to further increase the frame frequency so as to prevent occurrence of flickers (e.g., to increase the frame frequency to 240 Hz), but with the present embodiment, an arrangement is made wherein a black display line is formed every other scanning line in the pixel array by black insertion for interlace (FIG. 5), and accordingly, there is no need to increase the frame frequency so as to prevent occurrence of flickers (the frame frequency may still be 120 Hz). This point will be described in detail with reference to FIG. 6.

Figure 6:
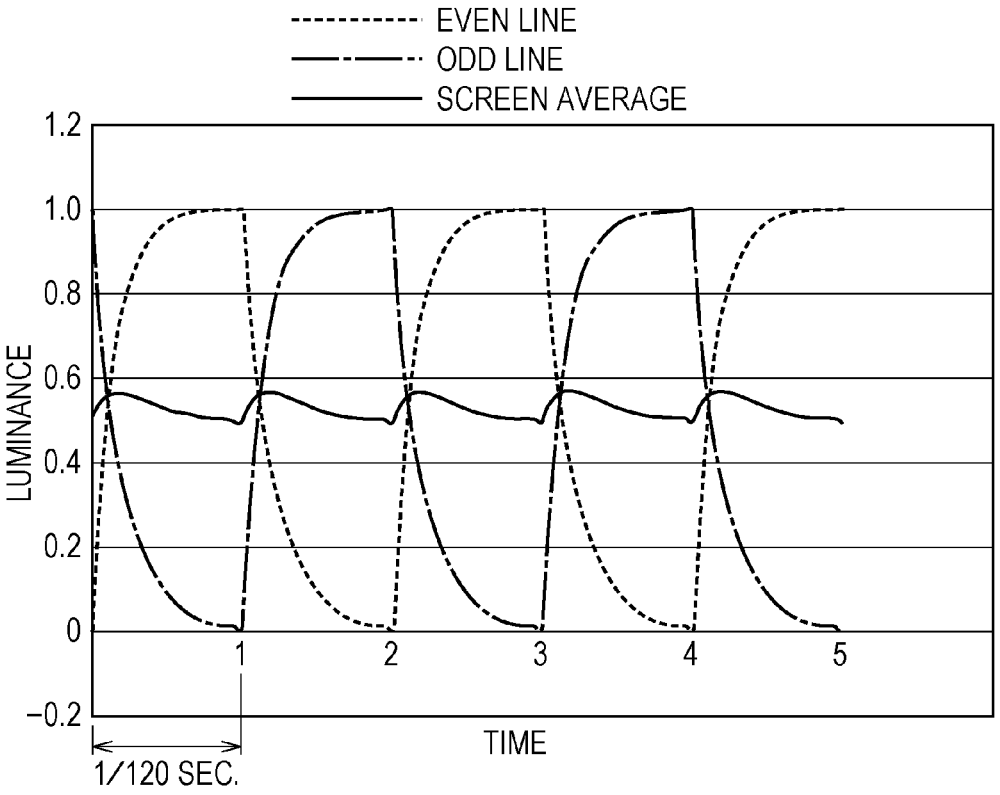
FIG. 6 is a waveform diagram for describing a flicker reduction effect in the first embodiment.

FIG. 6 illustrates luminance response of pixel liquid crystal to be subjected to back insertion for each frame. As illustrated in this FIG. 6, with the present embodiment, black insertion for an odd-numbered display line (hereinafter, referred to as "odd line"), and black insertion for an even-numbered display line (hereinafter, referred to as "even line") are alternately performed in increments of one frame. When assuming that one frame period is 1/120 seconds, in the event of having performed black insertion at a liquid crystal display device according to the related art, as illustrated with a dotted line in FIG. 6 for example, a 60-Hz flicker has occurred (flicker with two frame periods as one cycle). On the other hand, with the present embodiment, as illustrated in FIG. 6, so that a flicker in an odd line cancels out a flicker in an even line adjacent thereto, luminance of both lines changes. Also, with luminance response of pixel liquid crystal, response speed differs between change from brightness to darkness and change from darkness to brightness, and accordingly, even when the flickers of both lines are not completely cancelled out, with screen averaging, as illustrated with a solid line in FIG. 6, the frequency of a flicker becomes 120 Hz, that is, a frequency twice as much as the frequency of blinking of each of the odd lines and even lines, and a flicker level thereof is extremely reduced.

Also, with the present embodiment, with one frame of two adjacent frames, black insertion is performed on an odd-numbered scanning line, and with the other frame, black insertion is performed on an even-numbered scanning line (FIG. 5), and accordingly, in the event of displaying a still image, a high-resolution image (image of 1920×1080) is configured of two adjacent frames, the resolution is not reduced due to the above-mentioned black insertion for interlace.

As described above, according to the present embodiment, even if definition of display images or increase in the size of display panels advance, high display performance can be obtained regarding both of a moving image and a still image by double-speed interlace display.

1.4 Modification of First Embodiment

Figure 7:
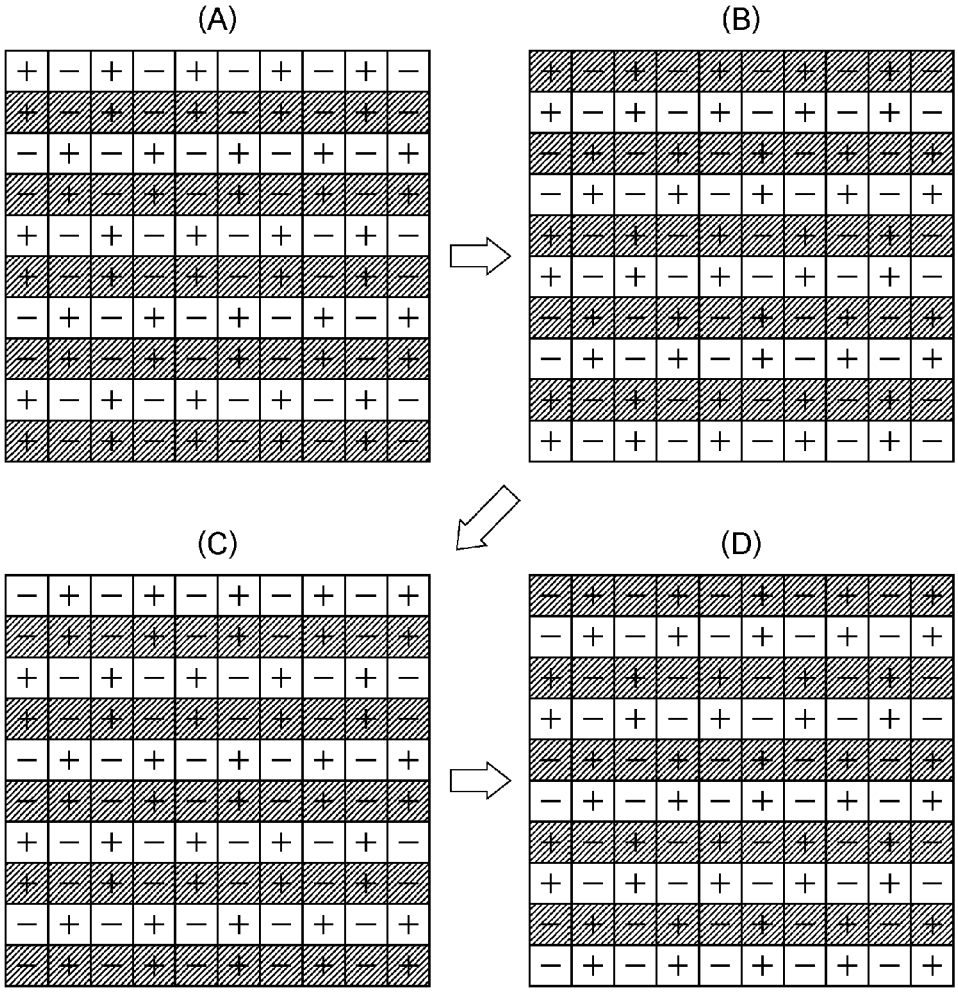
FIG. 7 illustrates schematic diagrams (A to D) illustrating a pixel voltage polarity pattern and a pattern of black insertion for interlace in screen display by a modification of the first embodiment.

With the above-mentioned embodiment, as illustrated in FIG. 5, the polarity of the pixel voltage Vp(i, j) is inverted not only in the horizontal direction but also in the vertical direction for each pixel, but black insertion is performed every other scanning line. Therefore, when excluding the pixel formation units for black display from the pixel array, only pixel formation units to which the pixel voltage Vp(i, j) having the same polarity is applied are arrayed in the vertical direction, and accordingly, there is conceived a possibility that a dot inversion driving effect is not sufficiently obtained. Therefore, with this in mind, the configuration of the first embodiment may be deformed so that the polarity of the pixel voltage Vp(i, j) is inverted in the horizontal direction for each pixel and inverted in the vertical direction for every two pixels, that is, what is called 2H dot inversion driving is performed. According to such a modification, a pattern of pixel voltage polarity and a pattern of black insertion for interlace become patterns as illustrated in FIG. 7 in the screen display, and occurrence of flickers due to alternating current driving of liquid crystal can be suppressed in a surer manner. Also, in order to obscure flickers on the display edge portions, 2H dot inversion driving is also suitable wherein a pattern of pixel voltage polarity is changed into a pattern of (+−−++−−++−−+) by subjecting the first line alone to 1H inversion instead of a pattern of (++−−++−−++−−) from the upper end in (A) in FIG. 7 to downward, and such a configuration wherein 2H dot inversion driving is performed is also included in the present modification.

With the above-mentioned embodiment, of the double-speed progressive image signal SP from the input image processing circuit 210, black insertion for interlace is realized by replacing the value of a pixel which makes up a scanning line to be subjected to black insertion with a black pixel value (FIG. 2, (C) and (D) in FIG. 4), but instead of this, there may be housed in the source driver 300 a circuit configured to switch voltage to be output as the data signal S(j) from the source driver 300 into between voltage equivalent to a pixel value that the double-speed progressive image signal SP indicates (the pixel value of a pixel to be displayed) and voltage equivalent to a black pixel value (this may also be applied to other embodiments). In this case, an image signal obtained by removing the value of a pixel which makes up a scanning line to be subjected to black insertion from the double-speed progressive image signal SP is output from the interlace circuit 220 as an image signal SI, and this image signal SI is given to the source driver 300 as an image signal DV, and accordingly, circuit amount and data transfer amount to the source driver 300 can be reduced.

Note that, with the above-mentioned embodiment, the externally received image signal DAT conforming to the interlaced scanning mode is converted into an image signal conforming to the progressive scanning mode at the IP conversion unit 212, and also, the frame frequency thereof is doubled at the FRC serving as the double-speed processing unit 216, thereby obtaining the double-speed progressive image signal SP, but IP conversion may be omitted as long as the image signal DAT to be externally received conforms to the progressive scanning mode. Also, in the event that the image signal DAT with a sufficiently high frame frequency is externally input from a relation with use of the present liquid crystal display device, conversion of the frame frequency (FRC) may also be omitted.

2. Second Embodiment

Figure 8:
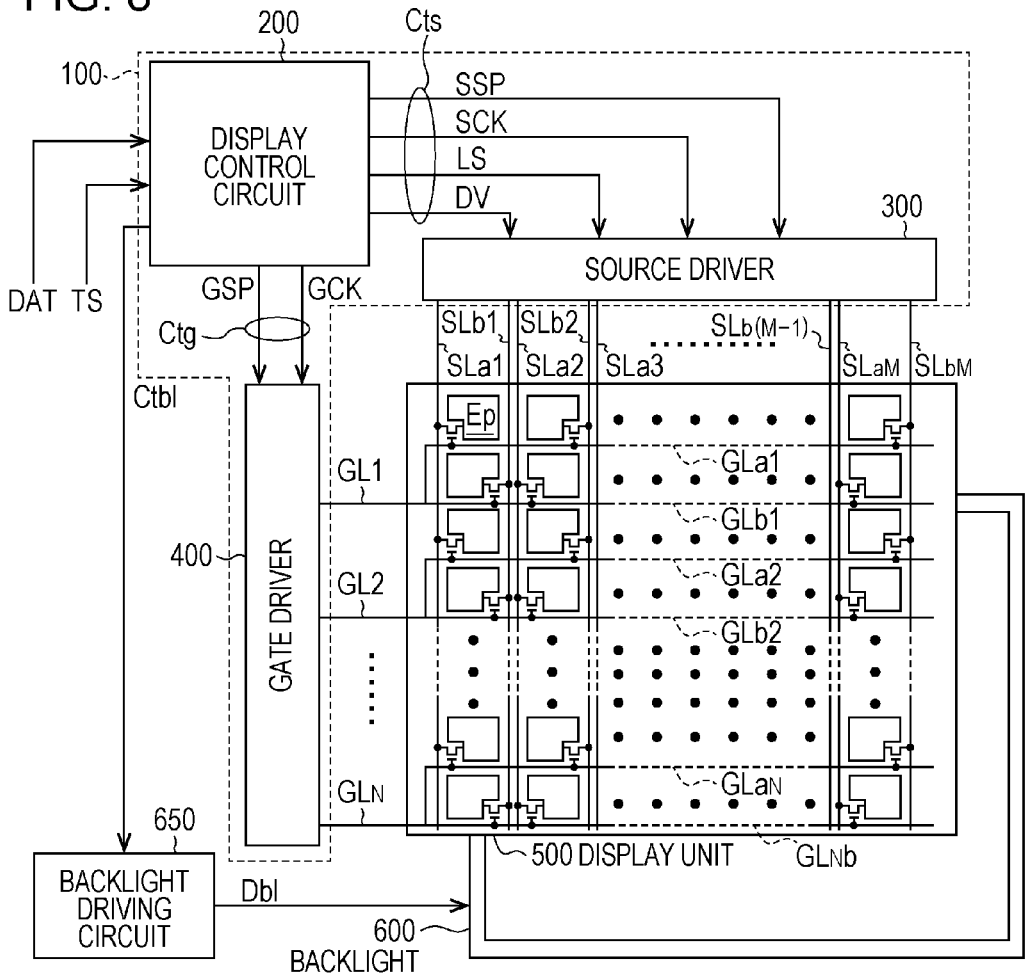
FIG. 8 is a block diagram illustrating a configuration of a liquid crystal display device according to a second embodiment of the present invention.

Next, a liquid crystal display device according to a second embodiment of the present invention will be described. The entire configuration of the liquid crystal device according to the present embodiment is as illustrated in FIG. 8, and basically the same as the entire configuration of the first embodiment (FIG. 1), but the configuration of the display unit 500 differs from that in the first embodiment. Therefore, hereinafter, description will be made with this different point as the center, and with configurations other than this different point, the same or corresponding portions are denoted with the same reference numerals, and detailed description will be omitted.

Figure 10:
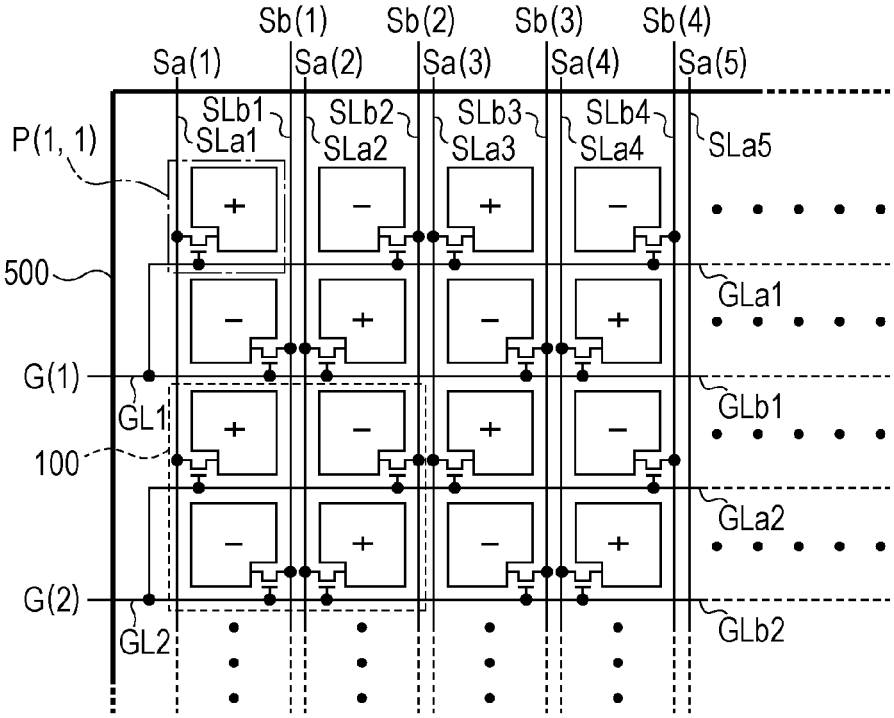
FIG. 10 is a schematic diagram illustrating an electrical connection configuration within a display unit in the second embodiment.
Figure 14:
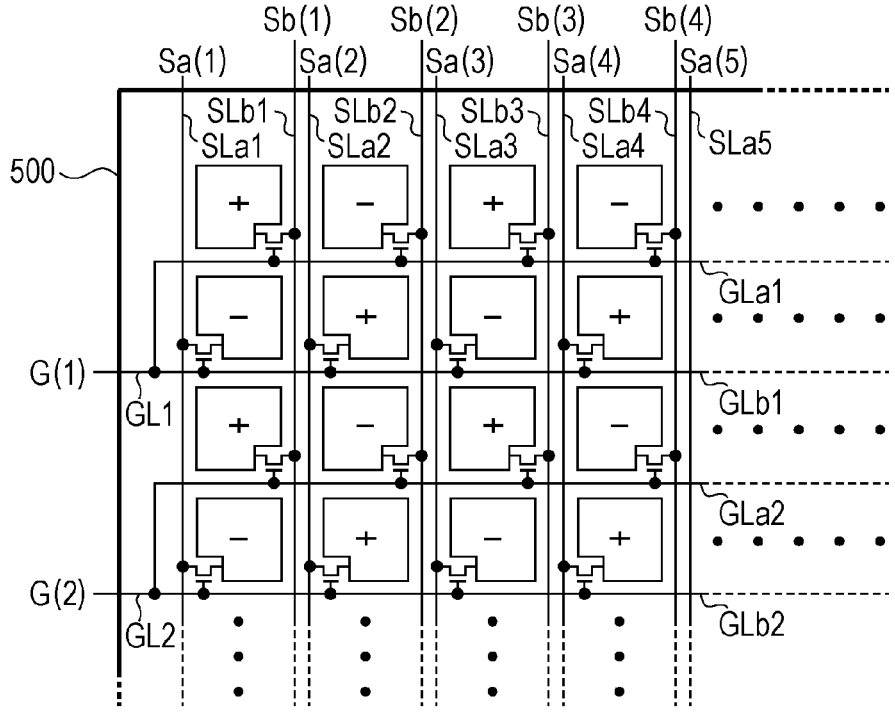
FIG. 14 is a schematic diagram illustrating another example of the electrical connection configuration within the display unit in the second embodiment.
Figure 15:
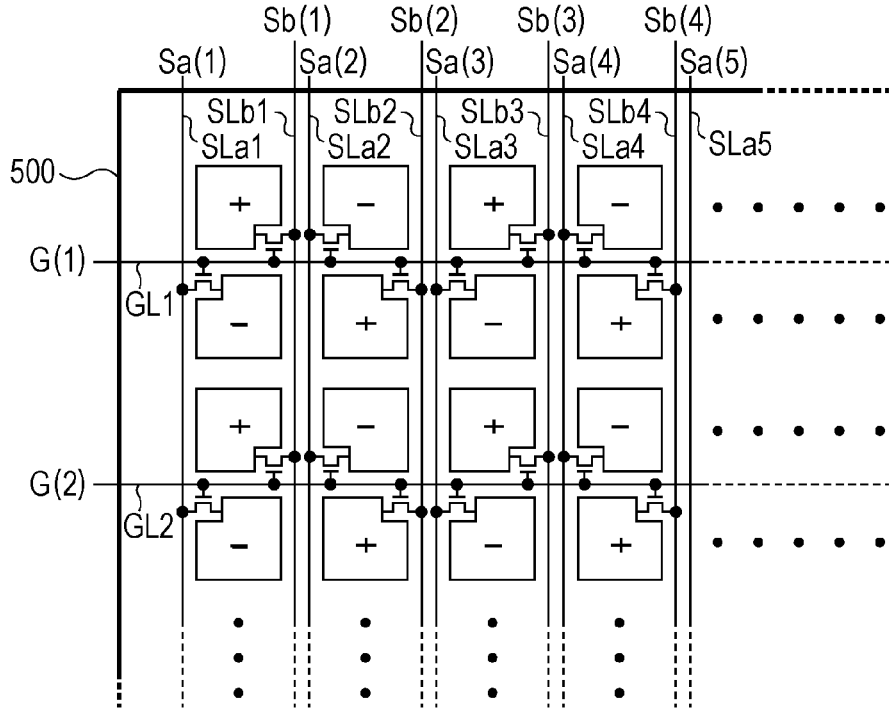
FIG. 15 is a schematic diagram illustrating yet another example of the electrical connection configuration within the display unit in the second embodiment.

FIG. 10 is a partially enlarged view schematically illustrating electric connection configuration within the display unit 500 in the present embodiment illustrated in FIG. 8, "+" or "−" appended to each pixel electrode in FIG. 10 indicates the polarity of voltage (pixel voltage) to be applied to this pixel electrode during a certain frame period (this is also applied to later-described FIG. 14 to FIG. 16). As illustrated in FIG. 8 and FIG. 10, a liquid crystal panel serving as the display unit 500 in the present embodiment includes multiple (2M) data signal lines Sla1, Slb1, Sla2, SLb2, . . . , SLaM, and SLbM connected to the source driver 300, and multiple (N) scanning signal lines GL1, GL2, . . . , and GLN connected to the gate driver 400, and these multiple data signal lines Sla1 through SLbM and these multiple scanning signal lines GL1 through GLN are disposed so as to mutually cross. Also, the display unit 500 includes a pixel array made up of multiple (2N×M) pixel formation units disposed in a matrix shape along the multiple data signal lines Sla1 to SLbM and multiple scanning signal lines GL1 to GLN.

Now, with the above-mentioned pixel array, a pixel formation unit row made up of M pixel formation units arrayed in the first direction (horizontal direction) which is a direction where the scanning signal line GLi extends will be referred to as "horizontal pixel formation unit row", and a pixel formation unit row made up of 2N pixel formation units arrayed in the second direction (vertical direction) which is a direction where the data signal lines SLaj and SLbj extend will be referred to as "vertical pixel formation unit row" (these may also be applied to later-described other embodiments). Also, hereinafter, of the pixel formation units included in the pixel array, a pixel formation unit in the k'th row and j'th column, that is, a pixel formation unit included in both of the k'th horizontal pixel formation unit row and the j'th vertical pixel formation unit row will be referred to as reference numeral "P(k, j)" (k=1 to 2N, j=1 to M).

The scanning signal lines GLi are connected to the pixel formation units corresponding any one of multiple sets (N sets) of horizontal pixel formation unit rows obtained by grouping the multiple pixel formation units P(k, j) (k=1 to 2N, j=1 to M) with two mutually adjacent horizontal pixel formation unit rows as one set in the above pixel array, and also included in two horizontal pixel formation unit rows which make up the corresponding set. With the present embodiment, as illustrated in FIG. 8 and FIG. 10, each of the scanning signal lines GLi is made up of two sub scanning signal lines GLai and GLbi which are mutually electrically connected, and the sub scanning signal line GLai which is one thereof is connected to the pixel formation units P(2i−1, j) (j=1 to M) of one of the two horizontal pixel formation unit rows corresponding to this scanning signal line GLi, and the other sub scanning signal line GLbi is connected to the pixel formation units P(2i, j) (j=1 to M) of the other of the two horizontal pixel formation unit rows. However, the electrical connection configuration within the display unit 500 is not restricted to those in FIG. 8 or FIG. 10, and as illustrated in FIG. 14 for example, an arrangement may be made wherein, of the two data signal lines SLaj and SLbj corresponding to the vertical pixel formation unit rows, the data signal line SLaj disposed on the left side in the drawing is connected to an even-numbered pixel formation unit row in this vertical pixel formation unit row, and the data signal line SLbj disposed on the right side is connected to an odd-numbered pixel formation unit row in this vertical pixel formation unit row. Also, as illustrated in FIG. 15 for example, an arrangement may be made wherein each of the scanning signal lines GLi is not divided into two sub scanning signal lines GLai and GLbi, and is disposed between two horizontal pixel formation unit rows corresponding to this scanning signal line GLi, and is connected to the pixel formation units P(2i−1, j) and P(2i, j) (j=1 to M) in these two horizontal pixel formation unit rows.

Each of the vertical pixel formation unit rows in the above-mentioned pixel array corresponds to any one of multiple sets of data signal lines obtained by grouping the multiple data signal lines SLa1, SLb1, SLa2, SLb2, . . . , SLaM, and SLbM with two adjacent data signal lines SLaj and SLbj as one set, the data signal line SLaj which is one of the two data signal lines which make up each set is connected to one of the two pixel formation units P(2i−1, j) and P(2i, j) connected to the same scanning signal line GLi (respectively connected to the sub scanning signal lines GLai and GLbi which make up the same scanning signal line GLi) of pixel formation units included in the vertical pixel formation unit row corresponding to this set, and the other data signal line SLbj of the two data signal lines is connected to the other of the two pixel formation units P(2i−1, j) and P(2i, j) (i=1 to N, j=1 to M). That is to say, as illustrated in FIG. 10, two data signal lines SLaj and SLbj which make up each set are disposed respectively on one side and other side of the vertical pixel formation unit row corresponding to this set, and the data signal line SLaj disposed on the one side (left side in the drawing) is connected to one of two pixel formation units P(2i−1, j) and P(2i, j) connected to the sub scanning signal lines GLai and GLbj, and the data signal line SLbj disposed on the other side (right side in the drawing) is connected to the other of the two pixel formation units P(2i−1, j) and P(2i, j). Note that, as with the above-mentioned display unit 500 in the present embodiment, a liquid crystal panel where two data signal lines are disposed regarding one vertical pixel formation unit row will be referred to as "double source panel".

Figure 11:
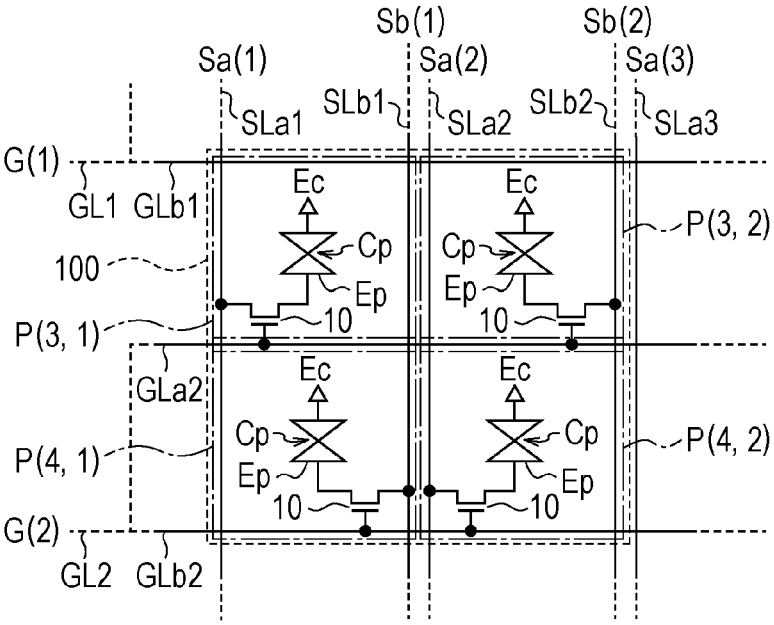
FIG. 11 is a circuit diagram illustrating an equivalent circuit of a pixel formation unit (equivalent to four pixels) in the second embodiment.

FIG. 11 is a circuit diagram illustrating an equivalent circuit of the pixel formation units P(k, j) in the display unit 500 (k=1 to 2N, j=1 to M). The pixel formation units P(k, j) include a pixel electrode Ep and a thin-film transistor (TFT) 10 serving as a switching element. The one sub scanning signal line GLai which makes up the i'th scanning signal line GLi is connected the gate terminal of the TFT 10 in the pixel formation units P(2i−1, j) included in the 2i−1'th horizontal pixel formation unit row, and one of the data signal lines SLaj and SLbj of the j'th set is connected to the source terminal of this TFT 10, and the pixel electrode Ep is connected to the drain terminal of this TFT 10 (i=1 to N). On the other hand, the other sub scanning signal line GLbi which makes up the i'th scanning signal line GLi is connected the gate terminal of the TFT 10 in the pixel formation units P(2i, j) included in the 2i'th horizontal pixel formation unit row, and the other of the data signal lines SLaj and SLbj of the j'th set is connected to the source terminal of this TFT 10, and the pixel electrode Ep is connected to the drain terminal of this TFT 10 (i=1 to N). The other configurations of the display unit 500 and the pixel formation units P(k, j) are the same as with the first embodiment (see FIG. 1 and FIG. 3), and accordingly, description will be omitted.

Figure 9:
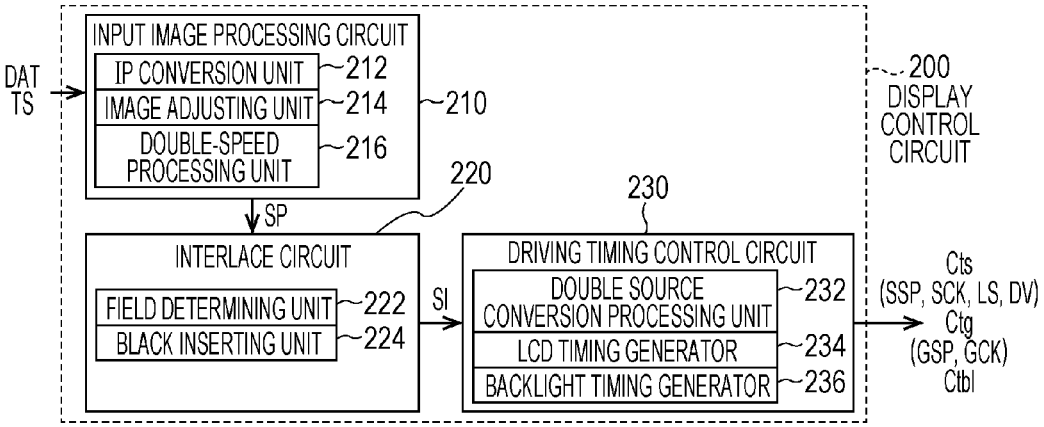
FIG. 9 is a block diagram illustrating a configuration of a display control circuit in the second embodiment.

FIG. 9 is a block diagram illustrating the configuration of the display control circuit 200 in the present embodiment. This display control circuit 200 includes, in the same way as with the first embodiment, an input image processing circuit 210, an interlace circuit 220, and a driving timing control circuit 230. Of these components, the driving timing control circuit 230 includes a double source conversion processing unit 232, and in this point, differs from the display control circuit 200 (FIG. 2) in the first embodiment. The other configuration of the display control circuit 200 in the present embodiment is the same as with the first embodiment, and accordingly, detailed description will be omitted.

With the present embodiment as well, in the same way as with the first embodiment, the image signal DAT conforming to the interlaced scanning mode to be externally input is converted into a double-speed progressive image signal SP by the input image processing circuit 210, this double-speed progressive image signal SP is converted into a double-speed interlace image signal SI by the interlace circuit 220, and this double-speed interlace image signal SI is input to the driving timing control circuit 230. With the driving timing control circuit 230, first, the double source conversion processing unit 232 generates a double-speed interlace image signal SI2 compatible with double source by changing the sequence of pixel values included in the double-speed interlace image signal SI thereof so as to correspond to the display unit 500 having a connection configuration as illustrated in FIG. 10. Hereinafter, this processing will be described in detail.

Figure 12:
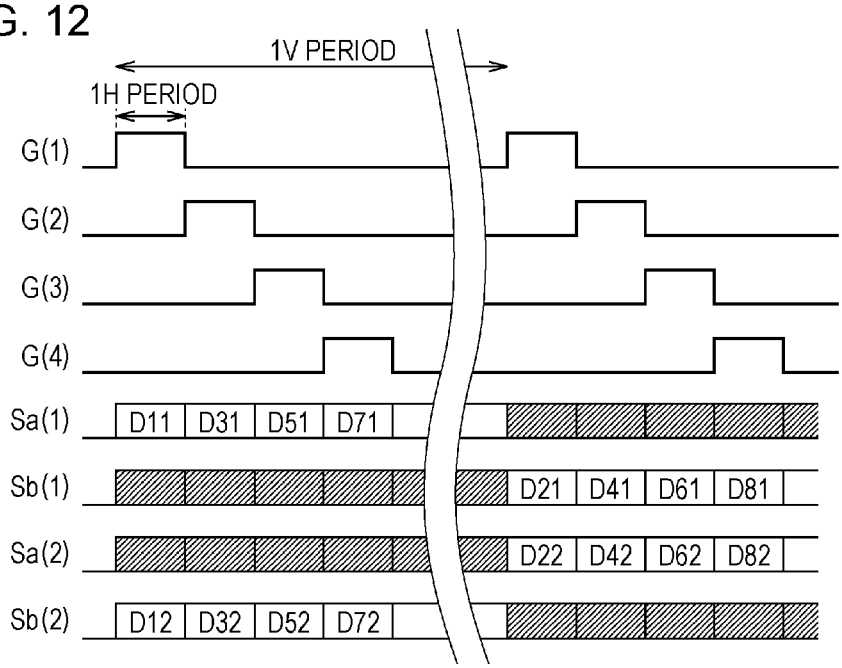
FIG. 12 is a timing chart of signals to be applied to the display unit in the second embodiment.

FIG. 12 is a timing chart of signals to be applied to the display unit 500 in the present embodiment. In FIG. 12, reference symbol "Dkj" indicates the value (gradation value) of a pixel to be formed by the pixel formation units P(k, j) in the k'th row and j'th column in the pixel array of the display unit 500, and hatching indicates a black pixel value (gradation value for black display). Now, if we say that the scanning signal G(i) to be applied to the i'th scanning signal line GLi is active (H level), the sub scanning signal lines GLai and GLbi which make up the scanning signal line GLi are both in an active state. At this time, the TFTs 10 of the pixel formation units P(2i−1, j) and P(2i, j) (j=1 to M) in the 2i−1'th and 2i'th horizontal pixel formation unit rows connected to the scanning signal lines GLi (sub scanning signal lines GLai and GLbi) go into an on state (i=1 to N). On the other hand, as illustrated in FIG. 10, with the display unit 500 in the present embodiment, if we say that j is an odd number, one data signal line SLaj of the two data signal lines SLaj and SLbj corresponding to the j'th vertical pixel formation unit is connected to the pixel formation unit P(2i−1, j), and the other data signal line SLbj is connected to the pixel formation unit P(2i, j), respectively. Also, if we say that j is an even number, one data signal line SLaj of the two data signal lines SLaj and SLbj is connected to the pixel formation unit P(2i, j), and the other data signal line SLbj is connected to the pixel formation unit P(2i−1, j), respectively.

With the display unit 500 having such a connection configuration, in order to perform image display with a pattern of black insertion for interlace as illustrated in FIG. 5, the scanning signal G(i) which goes to active (H level) at timing as illustrated in FIG. 12 has to be applied to the scanning signal line GL(i) (i=1, 2, . . . , N), and also, the data signals Sa(j) and Sb(j) of which the signal values serving as pixel values change as illustrated in FIG. 12 have to be applied to the data signal lines Slaj and Slbj (j=1, 2, . . . , M), respectively. Accordingly, for example, during a certain frame period, an image signal DV made up of pixel values arrayed in order of D11, D21(B), D22(B), D12, D13, D23(B), D24(B), D14, . . . at the first horizontal period, and arrayed in order of D31, D41(B), D42(B), D32, D33, D43(B), D44(B), D34, . . . at the second horizontal period, has to be supplied to the source driver 300. Next, during the next frame period, the image signal DV made up of pixel values arrayed in order of D11(B), D21, D22, D12(B), D13(B), D23, D24, D14(B), . . . at the first horizontal period, and arrayed in order of D31(B), D41, D42, D32(B), D33(B), D43, D44, D34(B), . . . at the second horizontal period, has to be supplied to the source driver 300. Note that "Dkj(B)" mentioned here indicates that the value of a pixel to be formed by the pixel formation unit P(k, j) in the k'th row and j'th column is a black pixel value.

The double source conversion processing unit 232 changes, as described above, in order to perform image display with a pattern of black insertion for interlace as illustrated in FIG. 5 at the display unit 500 having a connection configuration illustrated in FIG. 10, the sequence of pixel values included in the double-speed interlace image signal SI so that the pixel value Dkj or Dkj(B) appears in the above-mentioned sequence (see FIG. 12). Thus, a double-speed interlace image signal SI2 compatible with double source is generated as an interlace image signal compatible with the connection configuration illustrated in FIG. 10.

The LCD timing generating unit 234 generates a data start pulse signal SSP, a data clock signal SCK, a latch signal LS, and so forth as timing signals to be given to the source driver 300, and outputs source driver control signals Cts made up of these timing signals and an image signal DV which is a signal obtained by synchronizing the above-mentioned double-speed interlace image signal S12 compatible with double source with these timing signals. Also, the LCD timing generator 234 generates, in the same way as with the first embodiment, a gate start pulse signal GSP and a gate clock signal GCK and so forth as timing signals to be given to the gate driver 400, and outputs these as gate driver control signals Ctg. Also, the backlight timing generator 236 also generates a control signal to be given to the backlight driving circuit 650, and outputs this as a backlight driving control signal Ctbl, in the same way as with the above first embodiment.

The source driver 300 generates data signals Sa(1), Sb(1), Sa(2), Sb(2), . . . , Sa(M), and Sb(M) as illustrated in FIG. 12 based on the above-mentioned source driver control signals Cts (SSP, SCK, LS, and DV), and applies these to the data signal lines SLa1, SLb1, SLa2, SLb2, . . . , SLaM, and SLbM of the display unit 500, respectively. The gate driver 400, backlight driving circuit 650, and backlight 600 operate in the same way as with the first embodiment. The source driver 300, gate driver 400, backlight driving circuit 650, and backlight 600 thus operate, whereby voltage according to an image that the image signal DV represents is applied to liquid crystal at each of the pixel formation units P(k, j), so transmittance of light from the backlight 600 is controlled, and thus an image that the image signal DAT from the outside represents is displayed on the display unit 500 with a pattern of black insertion for interlace and also double speed (frame frequency twice as much as the original frame frequency) as illustrated in FIG. 5.

2.2 Operation

Next, operation of the liquid crystal display device according to the present embodiment will be described.

Figure 13:
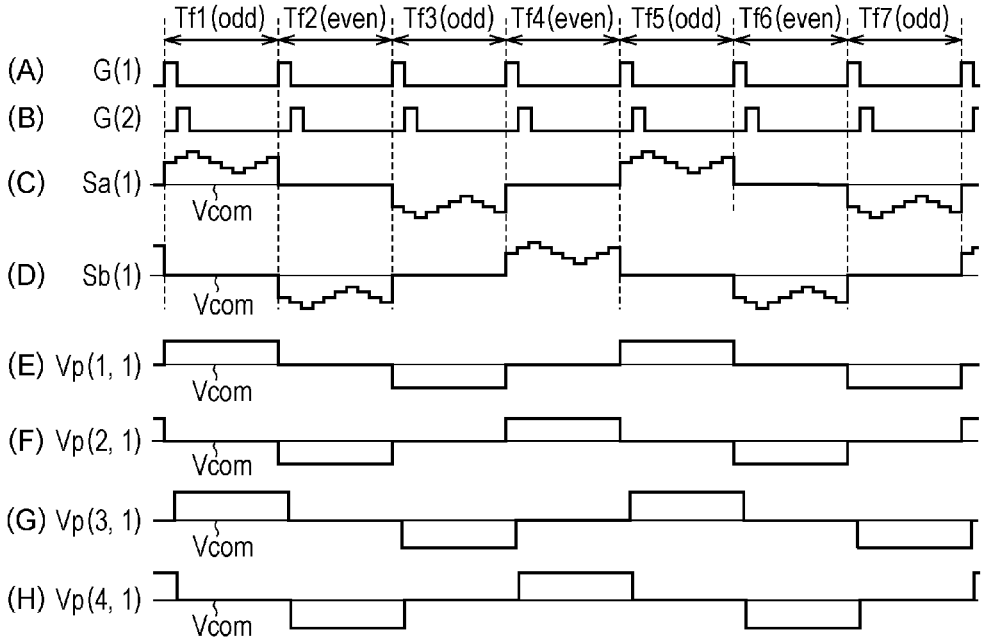
FIG. 13 is a signal waveform diagram (A to H) for describing operation of the liquid crystal display device according to the second embodiment.

FIG. 13 is a timing chart illustrating operation of the liquid crystal display device according to the present embodiment illustrated in FIG. 8. A pixel voltage polarity pattern and a pattern of black insertion for interlace in screen display by the present embodiment are, in the same way as with the first embodiment, as illustrated in FIG. 5. Hereinafter, operation of the liquid crystal display device according to the present embodiment will be described with reference to FIG. 13 and FIG. 5. Note that, with FIG. 13 and FIG. 5, for convenience of drawing, the number of pixels in the horizontal direction (=½ of data signal line count 2M) and the number of pixels in the vertical direction (=scanning signal line count N×2) are both set to 10. Also, with the liquid crystal display device according to the present embodiment as well, the normally black mode has been employed, and accordingly, when voltage to be applied to the liquid crystal (held voltage at the pixel capacitance Cp) has a value approximate to 0, that is, when voltage Vp(k, j) to be applied to the pixel electrode Ep (pixel voltage) is generally equal to the shared voltage Vcom, black display is performed.

An H-level signal is, as illustrated in (A) and (B) in FIG. 13, sequentially applied to the scanning signal lines GL1 to GLN in the display unit 500 as the scanning signals G(1) to G(N), and thus, the scanning signal lines GL1 to GLN sequentially go into an activated state. With pixel formation units P(2·ia−1, j) and P(2·ia, j) (j=1 to M) connected to the scanning signal line GLia (sub scanning signal lines GLaia and GLbia) in an activated state, that is, with the 2·ia−1'th and 2·ia'th horizontal pixel formation unit rows, the TFT 10 goes into an on state. On the other hand, the data signals Sa(j) and Sb(j) (j=1 to M) as illustrated in (C) and (D) in FIG. 13 are applied to the data signal lines SLaj and SLbj (j=1 to M) in the display unit 500, respectively. With the present embodiment as well, in the same way as with the first embodiment, the dot inversion driving system is employed as an alternating current driving system. However, with the present embodiment, the display unit 500 has a connection configuration as illustrated in FIG. 10, one of an odd-numbered pixel formation unit P(2i−1, j) or an even-numbered pixel formation unit P(2i, j) in each of the vertical pixel formation unit rows is connected to the data signal line SLaj, and the other is connected to the data signal line SLbj. Therefore, the polarity (voltage polarity with the shared voltage Vcom as a reference) of the data signal Sa(j) or Sb(j) does not change during each frame period, and also, black insertion for interlace is set to a pattern illustrated in FIG. 5, and accordingly, the data signals Sa(j) and Sb(j) have waveforms illustrated in (C) and (D) in FIG. 13.

According to application of the scanning signal G(i) to the scanning signal line GLi as described above, and application of the data signals Sa(j) and Sb(j) to the data signal lines SLaj and SLbj, with the present embodiment as well, voltage applied to the pixel liquid crystal of each of the pixel formation units P(k, j), that is, pixel voltage Vp(k, j) of each of the pixel formation units P(k, j) with the shared voltage Vcom as a reference changes in the same way as with the first embodiment (i=1 to N, k=1 to 2N, and j=1 to M). That is to say, as illustrated in (E) to (H) in FIG. 13, the pixel voltages Vp(k, j) change in order of positive voltage→black voltage→negative voltage→black voltage with one frame period (1/120 seconds) interval, and in a macroscopic manner, periodically changes with four frame periods as one cycle. Accordingly, the polarity of applied voltage to each pixel liquid crystal is inverted for each 2-frame period.

The pixel voltages Vp(k, j) change as described above, and accordingly, in the same way as with the first embodiment, there is performed at the display unit 500 double-speed interlace display wherein one screen worth of display image is configured of two adjacent frames, a pixel voltage polarity pattern and a pattern of black insertion for interlace as illustrated in (A) to (D) in FIG. 5 are repeated with four frame periods as one cycle (see (E) to (H) in FIG. 13). Note that, with the double-speed interlace display in the present embodiment, an odd-numbered frame is taken as the previous frame, and an even-numbered frame is taken as the subsequent frame, but an arrangement may be made wherein an even-numbered frame is taken as the previous frame, and an odd-numbered frame is taken as the subsequent frame.

2.3 Advantages

As described above, according to the present embodiment, double-speed interlace display is performed with a pixel voltage polarity pattern and a pattern of black insertion for interlace as illustrated in (A) to (D) in FIG. 5, and accordingly, the present embodiment yields the same advantage as with the first embodiment, and additionally yields a peculiar advantage as follows.

Specifically, according to the present embodiment, as illustrated in FIG. 10, the two data signal lines SLaj and SLbj are disposed in the vertical pixel formation unit rows, and two horizontal pixel formation unit rows are driven by one scanning signal line GLi at the same time (on/off of the TFTs 10 in the two horizontal pixel formation unit rows is controlled at the same time), and accordingly, twice as much as charging time in the first embodiment can be secured as charging time for pixel capacitance, and even if increase in definition of display images or increase in the size of liquid crystal panels advance, and also, even if increase in driving speed of liquid crystal panels advances to improve moving image performance, insufficient charging for pixel capacitance can be prevented.

Also, according to the present embodiment, the display unit 500 has a connection configuration as illustrated in FIG. 10, and accordingly, even when employing the dot inversion driving system to suppress flickers, as illustrated in (C) and (D) in FIG. 13, the polarities of the data signals Sa(j) and Sb(j) do not change within each frame period, and moreover, change in the values of the data signals Sa(j) and Sb(j) is also small. This also contributes to prevention of insufficient charging for pixel capacitance, and thus, consumption power of the source driver 300 is significantly reduced.

2.4 Modification of Second Embodiment

As described above, with the present embodiment, a pixel voltage polarity pattern and a pattern of black insertion for interlace go into a pattern as illustrated in FIG. 5 in the image display, but instead of this, a pattern as illustrated in FIG. 7 may be employed by employing the 2H dot inversion driving system as with the modification of the first embodiment. Thus, in the event of having excluded a pixel formation unit for black display in the pixel array, the polarities of the pixel voltages Vp(k, j) differ in the vertical direction for each pixel formation unit. In this case, an arrangement may be made wherein the connection configuration of the display unit 500 is changed into a configuration as illustrated in FIG. 16, and the data signals Sa(j) and Sb(j) that indicate pixel values in order corresponding to this connection configuration are output from the source driver 300.

Figure 16:
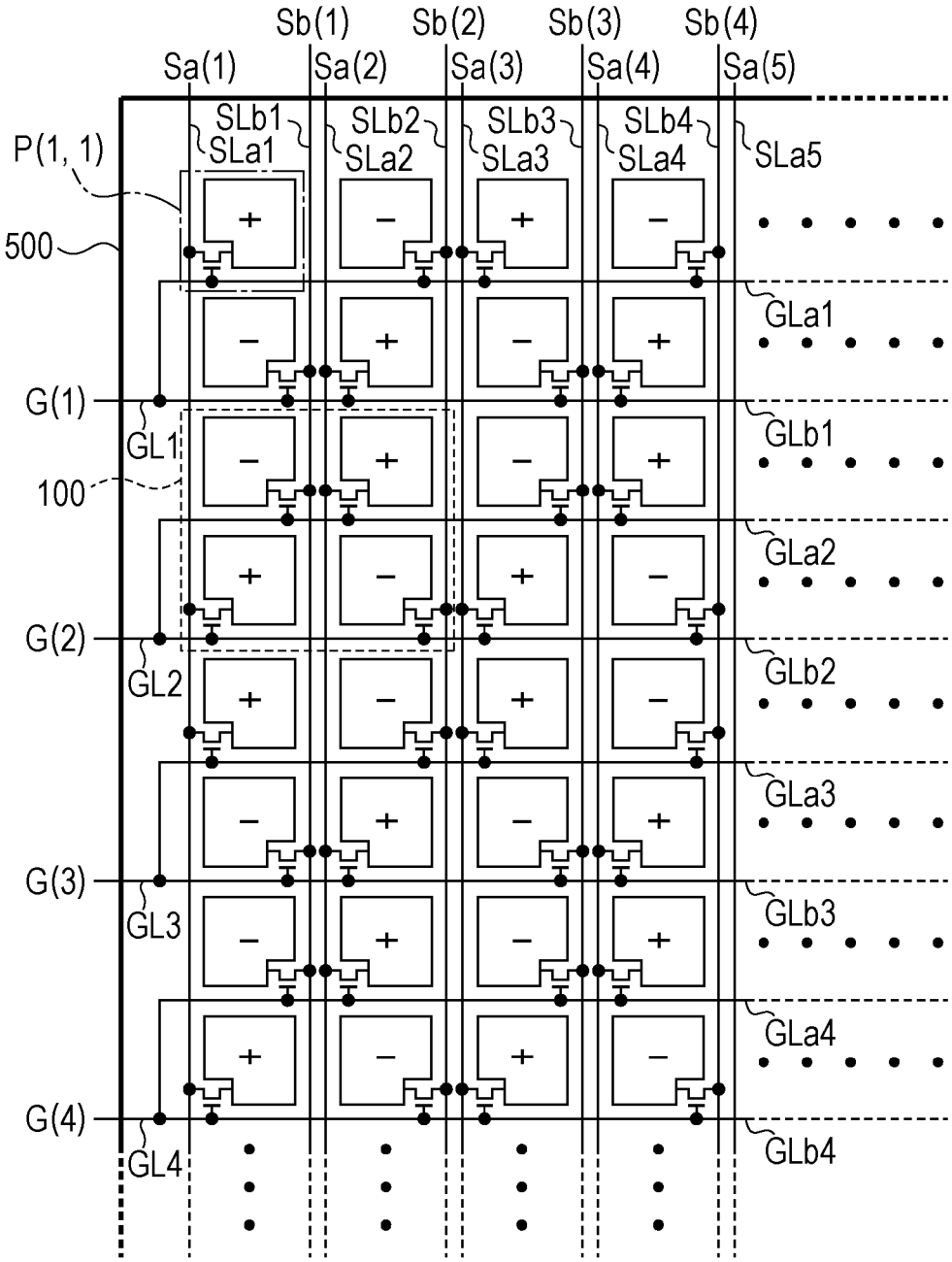
FIG. 16 is a schematic diagram illustrating an electrical connection configuration within a display unit in a modification of the second embodiment.

With the connection configuration illustrated in FIG. 16, in the same way as with the second embodiment, each of the scanning signal lines GLi corresponds to any one of multiple sets (N sets) of horizontal pixel formation unit rows to be obtained by grouping the multiple pixel formation units P(k, j) (k=1 to 2N, j=1 to M) with two horizontal pixel formation unit rows mutually adjacent in the pixel array of the display unit 500 as one set, and also connects to each pixel formation unit included in two horizontal pixel formation unit rows which make up the corresponding set. Also, each of the vertical pixel formation unit rows in the pixel array corresponds to any one of multiple sets of data signal lines to be obtained by grouping the multiple data signal lines SLa1 to SLbM with two adjacent data signal lines SLaj and SLbj as one set, the data signal line SLaj which is one of two data signal lines which make up each set is connected to one of the two pixel formation units P(2i−1, j) and P(2i, j) connected to the same scanning signal line GLi (connected to each of the sub scanning signal lines GLai and GLbi which make up the same scanning signal line GLi) of pixel formation units included the vertical pixel formation unit row corresponding to this set, and the other data signal line SLbj of the two data signal lines is connected to the other of the two pixel formation units P(2i−1, j) and P(2i, j) (i=1 to N, j=1 to M). In addition to this, with the present embodiment, the two pixel formation units P(2i, j) and P(2i+1, j) which are connected to the mutually different signal lines GLi and GLi+1 and are adjacent in the vertical direction are connected to the same data signal line SLaj or SLbj (i=1 to N−1, j=1 to M).

With the connection configuration as described above illustrated in FIG. 16, with the j'th vertical pixel formation unit row, a pixel formation unit connected to the data signal line SLaj which is one of the data signal lines SLaj and SLbj disposed in both sides thereof respectively, and a pixel formation unit connected to the other data signal line SLb are alternately arrayed two at a time in the vertical direction. Therefore, in the event of having employed the connection configuration as described above illustrated in FIG. 16, double-speed interlace display can be performed while performing 2H inversion driving without changing the polarities of the data signals Sa(j) and Sb(j) within each frame period. That is to say, an image can be displayed with a pixel voltage polarity pattern and a pattern of black insertion for interlace as illustrated in FIG. 7. Thus, occurrence of flickers due to alternating current driving of liquid crystal can be suppressed in a surer manner while securing the same advantage as with the second embodiment.

3. Third Embodiment

With the first and second embodiments, when focusing on the pixel formation units P(i, j), double-speed interlace display is performed wherein a frame which forms a pixel of an image to be displayed (hereinafter, referred to as "display frame") and a frame which forms a black pixel (hereinafter, referred to as "black frame") alternately appear ((E) to (H) in FIG. 4, (E) to (H) in FIG. 13), and accordingly, the state of the liquid crystal at the time of starting of each display frame is stable, and it is thought that there is no particularly need to drive the liquid crystal with driving voltage in which temporal change in a gradation value is enhanced to compensate for optical responsiveness of the liquid crystal (called "overshoot drive" or "OS drive"). However, as a result of the inventor of the present application performing study regarding this point, it was found that the final arrival state (transmittance) of the liquid crystal in a black frame depends on the state of the last frame since the optical responsiveness of the liquid crystal is slow. Accordingly, even in the event that double-speed interlace display is performed as described above, it is desirable to perform OS driving.

Incidentally, with normal OS driving, an enhanced image signal where temporal change in a gradation value is enhanced is obtained by comparing a gradation value (signal value) at the current frame in an image signal that represents an image to be displayed with a gradation value (signal value) at the last frame. However, in the event that double-speed interlace display is performed as with the first and second embodiments, the last frame when forming a pixel of an image to be displayed with each pixel formation unit is invariably a black frame, and accordingly, it has low significance to compare a gradation value at the current frame with a gradation value at the last frame. Therefore, in the event of performing double-speed interlace display as described above, it is desirable to obtain an enhanced image signal where temporal change in a gradation value is enhanced by comparing a gradation value at the current frame with a gradation value at a frame two frames ahead thereof. Therefore, with the liquid crystal display device according to the third embodiment of the present invention, OS driving for compensation of the optical responsiveness of the liquid crystal is performed by the following configuration. Hereinafter, the liquid crystal display device according to this third embodiment will be described.

Though the entire configuration of the liquid crystal device according to the present embodiment is the same as with the second embodiment (FIG. 8), the display control circuit 200 in the present embodiment includes a portion different from the second embodiment. Therefore, hereinafter, description will be made with the display control circuit 200 as the center, and with regard to other configurations, the same or corresponding portions will be denoted with the same reference numerals, and detailed description will be omitted.

Figure 17:
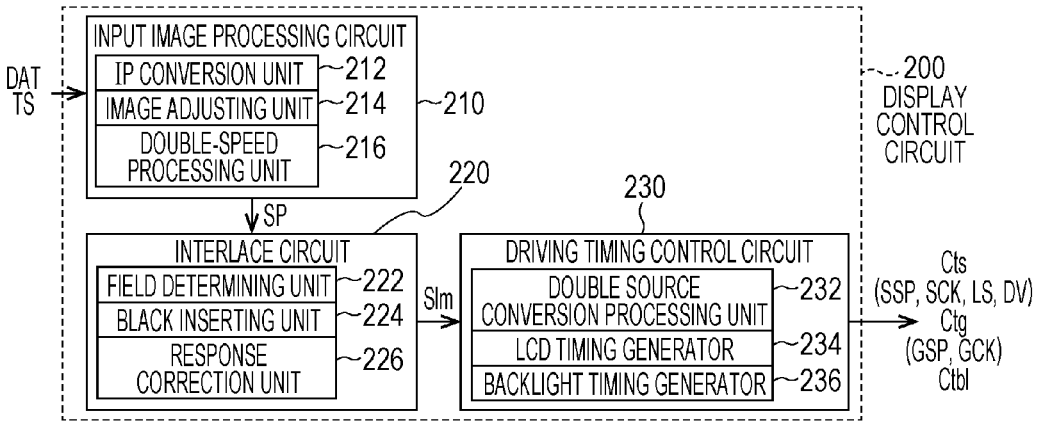
FIG. 17 is a block diagram illustrating a configuration of a display control circuit in a liquid crystal display device according to a third embodiment of the present invention.

FIG. 17 is a block diagram illustrating the configuration of the display control circuit 200 in the present embodiment. This display control circuit 200 includes, in the same way as with the second embodiment, an input image processing circuit 210, an interlace circuit 220, and a driving timing control circuit 230. Of these components, the interlace circuit 220 includes a response correction unit 226, and in this point, differs from the display control circuit 200 in the second embodiment (FIG. 9). Other configurations of the display control circuit 200 in the present embodiment are the same as those in the second embodiment, and accordingly, detailed description will be omitted.

With the present embodiment as well, in the same way as with the second embodiment, a double-speed interlace image signal SI is generated from the image signal DAT conforming to the interlaced scanning mode to be externally input, by the input image processing circuit 210, and the field determining unit 222 and black inserting unit 224 of the interlace circuit 220. This double-speed interlace image signal SI is input to the response correction unit 226.

Figure 18:
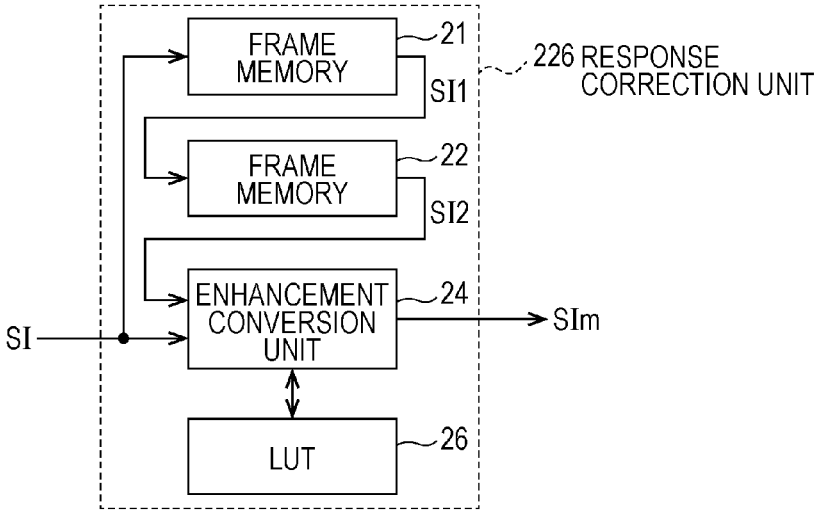
FIG. 18 is a block diagram illustrating a configuration of a response correction unit included in an interlace circuit within the display control circuit in the third embodiment.

The response correction unit 226 obtains, in order to compensate for the optical responsiveness of the liquid crystal panel serving as the display unit 500, an image signal where temporal change in a gradation value is more enhanced than that in this double-speed interlace image signal SI, as an enhanced double-speed interlace image signal Slm. Therefore, the response correction unit 226 includes, as illustrated in FIG. 18, first and second frame memory 21 and 22, an enhancement conversion unit 24, and a lookup table 26 (hereinafter, abbreviated as "LUT").

The double-speed interlace image signal SI input to the response correction unit 226 is first input to the first frame memory 21 and enhancement conversion unit 24. With the first frame memory 21, after the double-speed interlace image signal SI is stored once, this signal is read out as an image signal SI1 which is delayed one frame period, and is input to the second frame memory 22. With the second frame memory 21, the image signal SI1 delayed one frame period is stored once, and is then read out as an image signal SI2 further delayed one frame period, and input to the enhancement conversion unit 24.

In this manner, the double-speed interlace image signal SI and the image signal (hereinafter, referred to as "two-frame-delayed image signal") SI2 delayed two frame periods therefrom are input to the enhancement conversion unit 24 from the black inserting unit 224. The enhancement conversion unit 24 compares gradation values that these double-speed interlace image signal SI and two-frame-delayed image signal SI2 indicate respectively, thereby generating the enhanced double-speed interlace image signal Slm where temporal change in a gradation value is enhanced so that the state (transmittance) of the liquid crystal goes into a desired state (transmittance) in a shorter time. With the present embodiment, the enhanced double-speed interlace image signal Slm is generated using an LUT 26 as will be described below, but the enhanced double-speed interlace image signal Slm may be generated from the double-speed interlace image signal SI and two-frame-delayed image signal SI2 by predetermined calculation.

The LUT 26 is configured so as to correlate gradation value at the current frame of the enhanced image signal with two gradation values made up of a gradation value at the current frame of the double-speed interlace image signal SI, and a gradation value Lc at a frame two frames ahead thereof, and is realized with ROM (Read Only Memory), for example. The enhancement conversion unit 24 takes a signal value that the double-speed interlace image signal SI indicates as a gradation value at the current frame, takes a signal value that the two-frame-delayed image signal SI2 indicates as a gradation value Lp2 at a frame two frames ahead, obtains a gradation value Lm correlated with these gradation values Lc and Lp2, and outputs a signal made up of the gradation value Lm thus obtained as the enhanced double-speed interlace image signal Slm. This enhanced double-speed interlace image signal Slm is input from the interlace circuit 220 and input to the driving timing control circuit 230.

The driving timing control circuit 230 generates, in the same way as with the second embodiment, the source driver control signals Cts (SSP, SCK, LS, DV), gate driver control signals Ctg (GSP, GCK), and backlight driving control signal Ctbl from this enhanced double-speed interlace image signal Slm.

The source driver 300 in the present embodiment generates the data signals Sa(1) to Sb(M) based on the source driver control signals Cts (SSP, SCK, LS, DV), and applies these to the data signal lines SLa1 to SLbM of the display unit 500 respectively, thereby realizing OS driving. The optical responsiveness of the liquid crystal is improved by this OS driving, and accordingly, the moving image display performance further improves as compared to the first and second embodiments. Also, the final arrival state of the liquid crystal in a black frame is prevented from depending on the state of the last frame, and accordingly, a driving condition can be set without having to think of the arrival state of the liquid crystal in a black frame. As a result thereof, a complicated circuit such as with arrival luminance prediction is not necessary, and the response correction unit 226 for OS driving can be realized easily and also with low cost. Note that, with the response correction unit 226, black pixel values are excluded at the time of storing the double-speed interlace image signal SI in the frame memory 21 and 22, whereby capacity necessary for the frame memory 21 and 22 can be reduced to a half.

4. Fourth Embodiment

When a moving image is displayed at a held-type display device such as a liquid crystal display device, an afterimage of a moving object is caused with a human's vision, and the outline of the moving object is visually recognized in a blurred state (such a phenomenon is called "motion blurring"). With the first to third embodiments, black insertion for interlace as illustrated in FIG. 5 is performed, whereby an impulse effect is obtained, and this motion blurring is improved. However, the optical response of the liquid crystal is slow, and accordingly, black insertion is not quickly performed. Therefore, the liquid crystal display device according to the fourth embodiment of the present invention is configured so as to obtain a more stable impulse effect using backlight configured so as to control turning on and off for each area corresponding to a predetermined number of display lines. Hereinafter, this liquid crystal display device according to the fourth embodiment will be described.

Figure 19:
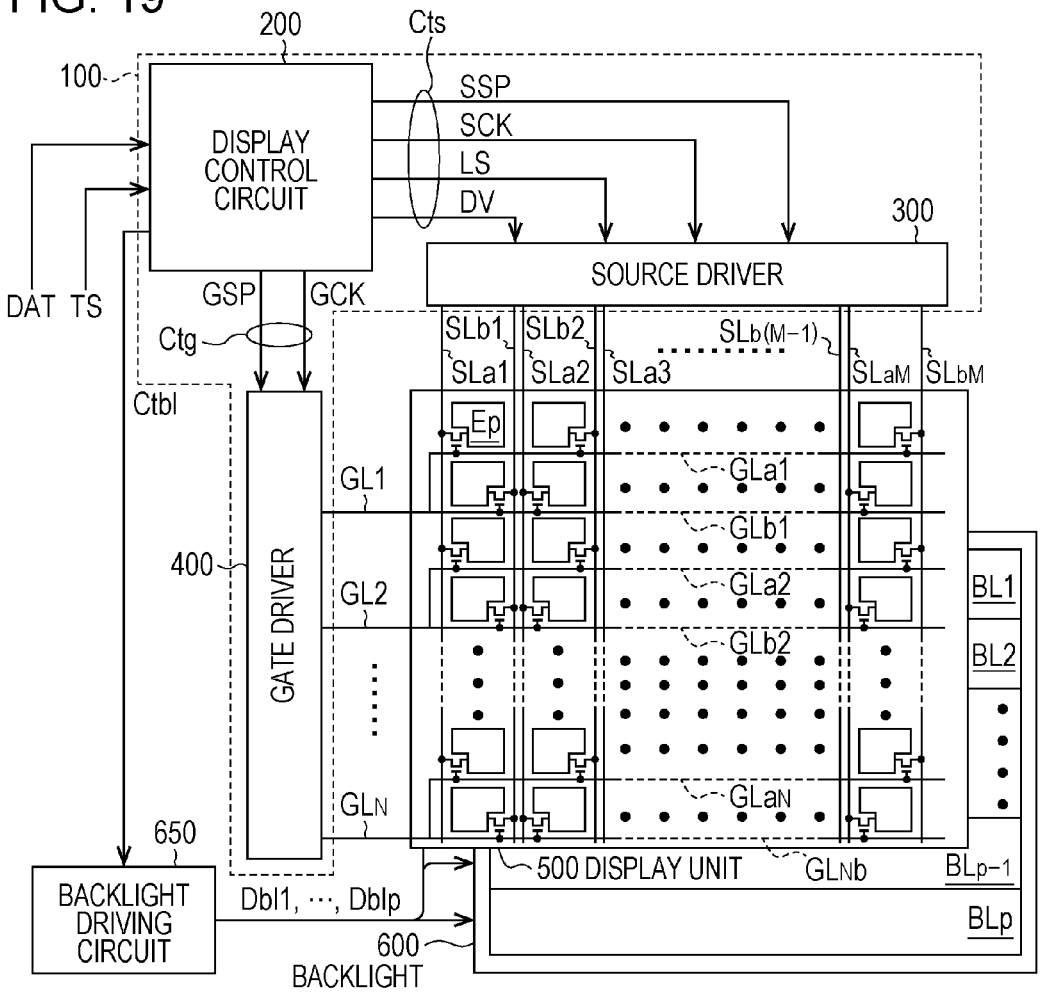
FIG. 19 is a block diagram illustrating a configuration of a liquid crystal display device according to a fourth embodiment of the present invention.

FIG. 19 is a block diagram illustrating the configuration of an active-matrix-type liquid crystal device according to the present embodiment. This liquid crystal display device includes, in the same way as with the first to third embodiments, a display unit 500 which is a liquid crystal panel conforming to the normally black mode, a display driving circuit 100 configured to drive the display unit 500 thereof, a backlight 600 serving as a planar lighting device configured to irradiate light on the rear face of the display unit 500 (liquid crystal panel), and a backlight driving circuit 650 configured to drive the backlight 600 thereof. The display driving circuit 100 includes a source driver 300 serving as a data signal line driving circuit, a gate driver 400 serving as a scanning signal line driving circuit, and a display control circuit 200, and this display control circuit 200 controls the source driver 300, gate driver 400, and backlight driving circuit 650.

However, the backlight 600 in the present embodiment is, unlike the backlights 600 in the first to third embodiments, configured so as to control turning on and off for each area extending in the horizontal direction corresponding to a predetermined number of display lines, that is, for each area (hereinafter, referred to as "lit increment area") BLn which is shorter in the vertical direction (n=1, 2, . . . , P). With the present embodiment, multiple light-emitting diodes (LEDs) are used as light sources in the lit increment areas BL1 to BLp, but cold-cathode tubes may be employed instead of these LEDs.

The backlight driving circuit 650 in the present embodiment is configured so as to drive such backlight 600, and according to this backlight driving circuit 650, the lit increment areas BL1 to BLp in the backlight 600 are controlled so as to light up and go out in conjunction with sequential driving of the scanning signal line GLi (backlight thus operated is called "scan backlight"). With the display control circuit 200 in the present embodiment, a control signal to be given to the backlight driving circuit 650 for operating the backlight 600 in this manner is generated as the backlight driving control signal Ctbl. Other configurations are the same as with the third embodiment, and accordingly, the same portions are denoted with the same reference numerals, detailed description will be omitted, and the present embodiment will be described below with a different portion as the center.

Figure 20:
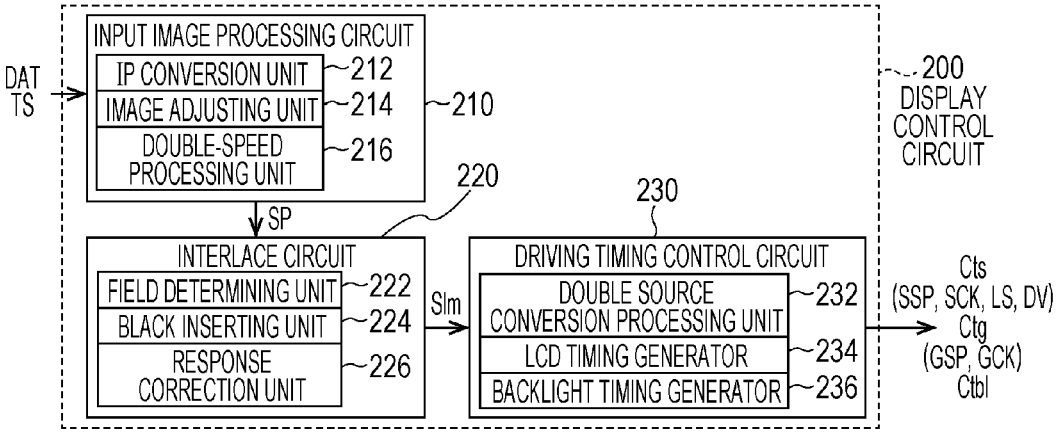
FIG. 20 is a block diagram illustrating a configuration of a display control circuit in the fourth embodiment.

FIG. 20 is a block diagram illustrating the configuration of the display control circuit 200 in the present embodiment. The display control circuit 200 includes, in the same way as with the third embodiment, an input image processing circuit 210, an interlace circuit 220, and a driving timing control circuit 230. Of these components, the backlight timing generator 236 in the driving timing control circuit 230 differs from that in the third embodiment (FIG. 17). The other configuration of the display control circuit 200 in the present embodiment is the same as with the third embodiment, and accordingly, detailed description will be omitted.

With the present embodiment as well, in the same way as with the third embodiment, the source driver control signals Cts (SSP, SCK, LS, DV) and gate driver control signals Ctg (GSP, GCK) are generated from the image signal DAT conforming to the interlaced scanning mode to be externally input, by the input image processing circuit 210, interlace circuit 220, and double source conversion processing unit 232 and LCD timing generator 234 of the driving timing control circuit.

Figure 21:
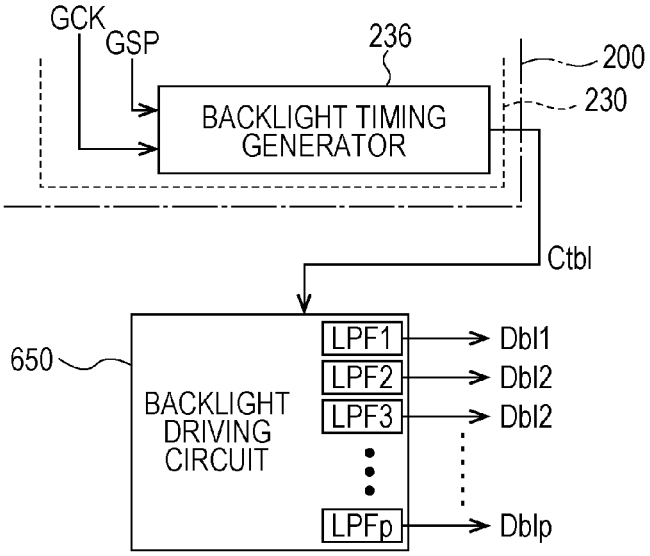
FIG. 21 is a block diagram for describing a backlight driving circuit in the fourth embodiment.

The backlight timing generator 236 included in the driving timing control circuit 230 in the present embodiment generates, as illustrated in FIG. 21, based on the gate driver control signals Ctg (GSP, GCK), the backlight driving control signal Ctbl synchronized with the gate driver control signals Ctg. This backlight driving control signal Ctbl is output from the display control circuit 200 and input to the backlight driving circuit 650.

The backlight driving circuit 650 generates p backlight driving signals Dbl1 to Dblp based on this backlight driving control signal. As illustrated in FIG. 21, p low-pass filters LPF1 to LPFp are provided to the backlight driving circuit 650, and the backlight driving signals Dbl1 to Dblp are output via these low-pass filters LPF1 to LPFp respectively, and are given to the backlight 600 as signals for controlling turning on and off of the lit increment areas BL1 to BLp. In this manner, turning on and off of the lit increment areas BL1 to BLp in the backlight 600 is controlled by the backlight driving signals Dbl1 to Dblp passed through the low-pass filters LPF1 to LPFp. The properties of these low-pass filters LPF1 to LPFp are set so that the amount of irradiation light to the liquid crystal panel serving as the display unit 500 from the backlight 600 does not extremely fluctuate between the lit increment areas BL1 to BLp. Such low-pass filters LPF1 to LPFp are employed, whereby deterioration in display quality due to block separation or the like is suppressed.

Figure 22:
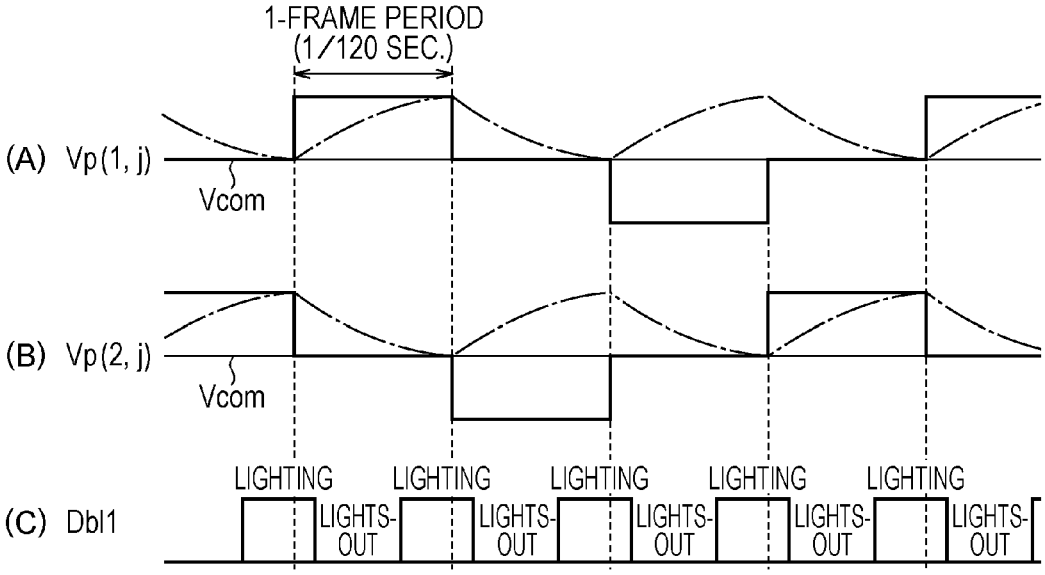
FIG. 22 is a signal waveform diagram (A to C) for describing operation of backlight in the fourth embodiment.

FIG. 22 is a signal waveform diagram for describing the operation of the backlight 600 in the present embodiment. With the present embodiment as well, voltage that indicates a pixel value that the image signal DV represents is applied to the pixel electrodes Ep by the gate driver 400 applying the scanning signals G(1) to G(N) to the scanning signal lines GL1 to GLN of the display unit 500 based on the gate driver control signals Ctg (GSP, GCK), and also the source driver 300 applying the data signals Sa(1) to Sb(M) to the data signal lines SLa1 to SLbM of the display unit 500 based on the source driver control signals Cts (SSP, SCK, LS, DV). Thus, the voltages (pixel voltages) Vp(k, j) of the pixel electrodes Ep change, as illustrated in a solid line in (A) and (B) in FIG. 22, in order of positive voltage→black voltage→negative voltage→black voltage with one frame period (1/120 seconds) interval, and in a macroscopic manner, periodically change with four frame periods as one cycle. Thus, the luminance of a pixel formed by each of the pixel formation units P(k, j) of the display unit 500 changes as illustrated in a dashed-dotted line in (A) and (B) in FIG. 22 (this dashed-dotted line indicates the optical response of this pixel liquid crystal when voltage corresponding to the pixel voltage Vp(k, j) as illustrated in a solid line is applied to a pixel liquid crystal).

As illustrated in a dashed-dotted line in (A) and (B) in FIG. 22, it takes considerable time until the luminance of a pixel reaches desired luminance due to the optical response property of the pixel liquid crystal. Therefore, it is desirable to suppress irradiation of light to the display unit 500 (liquid crystal panel) from the backlight 600 during a period in a transitional state until the luminance of a pixel reaches desired luminance. Therefore, as illustrated in (C) in FIG. 22, the backlight driving signals Dbln (n=1 to p) are generated by the backlight driving circuit 650 so that the lit increment areas BLn in the backlight 600 go into a lighted state during a predetermined period including before and after the start time point of a black frame regarding each of the corresponding pixel formation units P(k, j) (frame period when black voltage is applied to the pixel electrode Ec of this pixel formation unit P(k, j)), and go out during a period other that, that is, during a period in a transitional state until a pixel to be formed by the corresponding pixel formation unit P(k, j) reaches desired luminance.

Turning on and off of the lit increment areas BL1 to BLp in the backlight 600 is controlled by such backlight driving signals Dbl1 to Dblp, and accordingly, an impulse effect is stabilized, and moving image performance can further be improved. Here, it is desirable to set a ratio during each frame period of a period while the lit increment areas BLn (n=1 to p) in the backlight 600 have gone out to ½ or more. Thus, the optical response of the liquid crystal during a limited period is controlled without taking light amount integration during an off period into consideration, whereby crosstalk between frames is more completely eliminated, and motion blurring can further be reduced.

Instead of conversion into impulses by controlling turning on and off of the lit increment areas BLn in such a backlight 600, in the event of performing conversion to impulses using black insertion according to application of black voltage to the liquid crystal panel serving as the display unit 500, it has been said that a impulse conversion effect goes to the maximum when setting the ratio of a period for displaying a black pixel to around 3/4. However, in this case, even when setting the ratio of a period for displaying a black pixel to around 3/4, a sufficient impulse conversion effect as with the present embodiment is not obtained due to the optical responsiveness of the liquid crystal. Also, in this case, it is necessary for preventing flickers due to black insertion to increase the driving frequency (e.g., up to 240 Hz), and further, there is also caused a problem in that crosstalk between frames occurs due to the optical responsiveness of the liquid crystal.

Note that, in (A) and (B) in FIG. 22, the pixel voltages Vp(1, j) and Vp(2, j) are drawn as if they changed at the same time, but in reality, time points when the voltages (pixel voltages Vp(k, j) and Vp(k+1, j)) of pixel electrodes Ep adjacent in the vertical direction changed are shifted one horizontal period. Therefore, in the event that one lit increment area BLn corresponds to q (multiple) display lines, it is necessary to set the timing of turning on and off of the lit increment area BLn thereof by taking lag of a (q−1) horizontal period into consideration. However, the q is set so that a ratio q/N (N is the number of scanning signal lines) has a sufficiently small value, and accordingly, in general, the lag of the (q−1) horizontal period does not cause a problem at the time of setting the timing of turning on and off of the lit increment area BLn.

5. Other Embodiments

Figure 23:
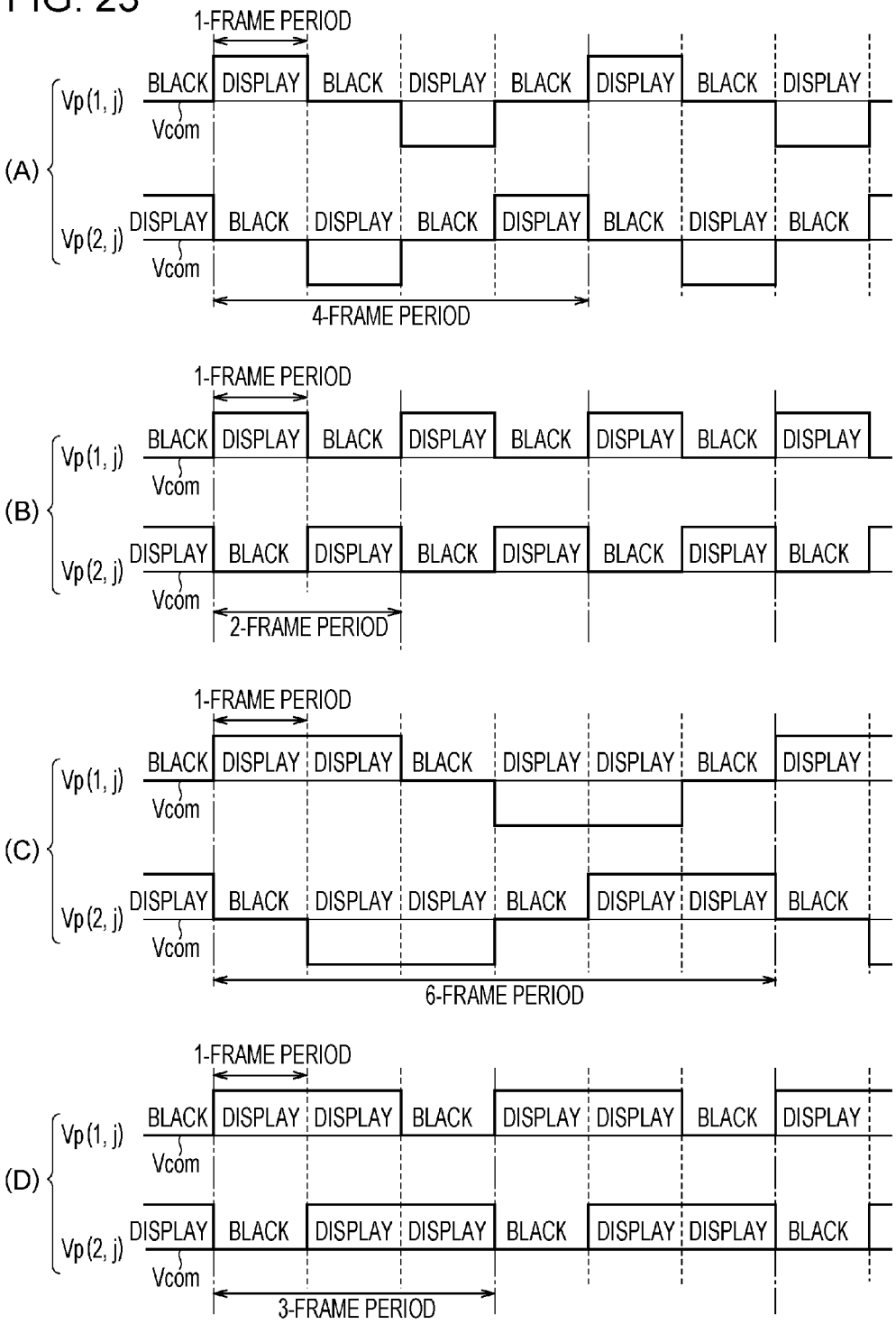
FIG. 23 illustrates timing charts (A to D) for describing another embodiment of the present invention.

As described above, with the liquid crystal display devices according to the embodiments, the pixel voltage Vp(k, j) with voltage applied to the pixel liquid crystal of each of the pixel formation units P(k, j), that is, with the shared voltage Vcom as a reference, changes in order of positive voltage→black voltage→negative voltage→black voltage with one frame period (1/120 seconds) interval as illustrated in (A) in FIG. 23, in a macroscopic manner, periodically changes with four frame periods as one cycle. When viewing this from a viewpoint regarding whether a pixel formed by the pixel formation units P(k, j) is a pixel of an image to be displayed or a black pixel, a display frame and a black frame alternately appear. Accordingly, in the event of having applied the present invention to an active-matrix-type display device conforming to the voltage control mode which does not need alternating current driving as with a liquid crystal display device, macroscopically, the pixel voltage Vp(k, j) periodically changes with two frame periods as one cycle as illustrated in (B) in FIG. 23. This means, as with the case of (A) in FIG. 23, that a display frame and a black frame alternately appear. Note that the present invention may be applied to not only an active-matrix-type display device conforming to the voltage control mode as described above but also an active-matrix-type display device conforming to the current control mode (e.g., organic EL (Electroluminescenece) display device).

According to the embodiments, with the black inserting unit 224 within the interlace circuit 220, a black signal is inserted in the progressive image signal SP every other horizontal period (FIG. 4, FIG. 13), and a black display line appears on the display screen every other scanning line (FIG. 5), but black insertion for interlace in the present invention is not restricted to such a mode. For example, an arrangement may be made wherein a black signal is inserted in the progressive image signal SP every three horizontal periods, and a black display line appears on the display screen every three scanning lines. In the event of having employed a liquid crystal display device having such a configuration, the pixel voltage Vp(k, j) changes in order of positive voltage→positive voltage→black voltage→negative voltage→negative voltage→black voltage with one frame period interval as illustrated in (C) in FIG. 23, in a macroscopic manner, periodically changes with six frame periods as one cycle. Also, in the event of having applied such a configuration to an active-matrix-type display device conforming to the voltage control mode which does not need alternating current driving, macroscopically, the pixel voltage Vp(k, j) periodically changes with three frame periods as one cycle as illustrated in (D) in FIG. 23. In either case of (C) in FIG. 23 and (D) in FIG. 23, when viewing this from a viewpoint regarding whether a pixel formed by the pixel formation units P(k, j) is a pixel of an image to be displayed or a black pixel, one black frame appears each time two display frames appear. According to black insertion for interlace by the pixel voltage Vp(k, j) as illustrated in (C) in FIG. 23 or (D) in FIG. 23, mean luminance of the display screen increases as compared to the first to fourth embodiments ((A) in FIG. 23), and accordingly, a bright display image can be obtained.

Figure 24:
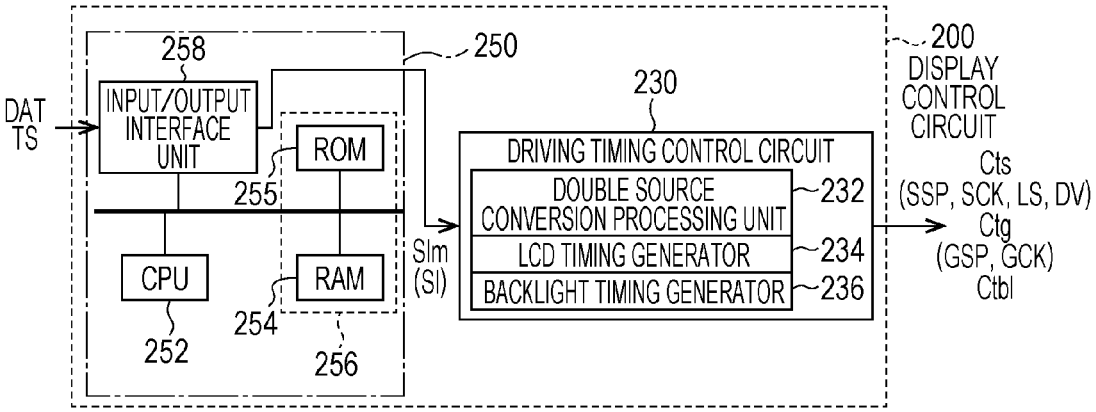
FIG. 24 is a block diagram illustrating a configuration of a display control circuit in yet another embodiment of the present invention.

With the above embodiments, IP conversion, frame frequency conversion, and black insertion for interlace for obtaining the double-speed interlace image signal SI and so forth have been realized as the input image processing circuit 210 and interlace circuit 220 in a hardware manner (FIG. 2, FIG. 9, FIG. 17, FIG. 20), but instead of this, a part or all of these functions may be realized in a software manner by the CPU or the like executing a predetermined program. In this case, the display control circuit 200 may be configured so as to include, as illustrated in FIG. 24 for example, the above-mentioned driving timing control circuit 230, and also a CPU 252 serving as a central processing unit, memory 256 made up of RAM (Random Access Memory) 254 and ROM (Read-Only Memory) 255, and a data processing unit 250 made up of an input/output interface unit 258. In the event of a liquid crystal display device having this configuration, the program is typically stored in the ROM 255 before a maker ships this liquid crystal display device. This ROM 255 is preferably writable PROM (Programmable ROM), and more preferably rewritable EEPROM (Electrically Erasable Programmable ROM). Also, in the event that this liquid crystal display device is connected to, for example, a personal computer, a user purchases CD-ROM or DVD-ROM serving as a recording medium of the program, mounts this on a CD-ROM driving device or the like of the personal computer thereof, reads out the program thereof from the CD-ROM or the like, transfers this to the data processing unit 250 of this liquid crystal display device, and stores in the ROM 255. Also, instead of this, an arrangement may be made wherein the personal computer thereof receives the program transmitted via a predetermined communication line, transfers this to the data processing unit 250 of this liquid crystal display device, and stores in the ROM 255. Also, as programmable devices instead of personal computers, in recent years, large-scale FPGAs (Field-Programmable Gate Arrays) have developed, and further, programmable ICs (Integrated Circuits) such as Cell (registered trademark) or the like have developed, and consequently, driving of the present invention and image processing necessary for the present invention have been able to be performed without designing particular hardware. The diving method of the present invention does not depend on the implement mode of an IC, and accordingly, a program for realizing driving of the present invention with such an IC (more generally, programmable device), more specifically, a program causing a programmable device to generate a signal for controlling a display driving circuit to drive a display unit, and a recording medium such as EEPROM or the like in which the program thereof is stored so as to be supplied to this programmable device, with the display device according to the present invention, also belong to the present invention.

In the event that having applied the present invention to a liquid crystal display device as with the embodiments, a liquid crystal panel conforming to any mode, such as a liquid crystal panel conforming to the VA (Vertical Alignment) system, a liquid crystal panel conforming to the IPS (In Plane Switching) method, or the like, may be employed as the display unit 500, but it is desirable to employ a liquid crystal panel conforming to the VA system. In the event of employing a liquid crystal panel conforming to the VA system, as compared to liquid crystal panels conforming to other methods, the optical response of the liquid crystal using a black frame is relatively fast, and driving can be performed in a more stable manner. Also, the liquid crystal panels conforming to the VA system also have an advantage wherein the contrast ratio is basically high, and adjustment of gradation is facilitated. Note that, as the liquid crystal panel conforming to the VA system, various types of liquid crystal panel may be employed, such as a liquid crystal panel employing polymer sustained alignment (PSA: Polymer Sustained Alignment) technology, a liquid crystal panel employing optical alignment technology called UV2A, and so forth.

APPENDIX 1

A display device which is an active-matrix-type display device configured to display an image using a progressive image signal which is an image signal based on progressive scanning, comprising:

a display unit including a pixel array made up of a plurality of pixel formation units disposed in a matrix shape; and a display driving circuit configured to drive the display unit based on the progressive image signal;

wherein the display driving circuit drives, during a frame period while image display is performed based on a first signal which is one frame signal of two adjacent frame signals included in the progressive image signal, the display unit so that images of odd-numbered scanning lines in an image that this first signal represents are formed of a pixel formation unit group in odd-numbered scanning lines in the pixel array, and also, a black display line is formed of a pixel formation unit group in even-numbered scanning lines in the pixel array;

and wherein the display driving circuit drives, during a frame period while image display is performed based on a second signal which is the other frame signal of the two adjacent frame signals, the display unit so that images of even-numbered scanning lines in an image that this second signal represents are formed of a pixel formation unit group in even-numbered scanning lines in the pixel array, and also, a black display line is formed of a pixel formation unit group in odd-numbered scanning lines in the pixel array.

APPENDIX 2

The display device according to Appendix 1, wherein the display unit is a liquid crystal panel conforming to the VA system.

APPENDIX 3

A program causing a programmable device to generate a signal for controlling the display driving circuit to drive the display unit at a display device according to Appendix 1.

APPENDIX 4

A recording medium in which a program causing a programmable device to generate a signal for controlling the display driving circuit to drive the display unit is stored so as to be supplied to this programmable device at a display device according to Appendix 1.

APPENDIX 5

A display driving circuit for an active-matrix-type display device including a display unit including a pixel array made up of a plurality of pixel formation units disposed in a matrix shape, configured to display an image on this display unit using a progressive image signal which is an image signal based on progressive scanning, wherein the display driving circuit drives, during a frame period while image display is performed based on a first signal which is one frame signal of two adjacent frame signals included in the progressive image signal, the display unit so that images of odd-numbered scanning lines in an image that this first signal represents are formed of a pixel formation unit group in odd-numbered scanning lines in the pixel array, and also, a black display line is formed of a pixel formation unit group in even-numbered scanning lines in the pixel array;

and wherein the display driving circuit drives, during a frame period while image display is performed based on a second signal which is the other frame signal of the two adjacent frame signals, the display unit so that images of even-numbered scanning lines in an image that this second signal represents are formed of a pixel formation unit group in even-numbered scanning lines in the pixel array, and also, a black display line is formed of a pixel formation unit group in odd-numbered scanning lines in the pixel array.

APPENDIX 6

A driving method for an active-matrix-type display device including a display unit including a pixel array made up of a plurality of pixel formation units disposed in a matrix shape, configured to display an image on this display unit using a progressive image signal which is an image signal based on progressive scanning, the method comprising:

a step configured to drive, during a frame period while image display is performed based on a first signal which is one frame signal of two adjacent frame signals included in the progressive image signal, the display unit so that images of odd-numbered scanning lines in an image that this first signal represents are formed of a pixel formation unit group in odd-numbered scanning lines in the pixel array, and also, a black display line is formed of a pixel formation unit group in even-numbered scanning lines in the pixel array; and a step configured to drive, during a frame period while image display is performed based on a second signal which is the other frame signal of the two adjacent frame signals, the display unit so that images of even-numbered scanning lines in an image that this second signal represents are formed of a pixel formation unit group in even-numbered scanning lines in the pixel array, and also, a black display line is formed of a pixel formation unit group in odd-numbered scanning lines in the pixel array.

INDUSTRIAL APPLICABILITY

The present invention is applied to an active-matrix-type display device and a driving method thereof, and may be applied to an active-matrix-type liquid crystal display device using a switching element such as a thin-film transistor or the like, for example.

REFERENCE SIGNS LIST

10 thin-film transistor (TFT) (switching element)
100 display driving circuit
200 display control circuit
210 input image processing circuit (signal format converter)
212 IP conversion unit
216 double-speed processing unit (frame frequency converter)
220 interlace circuit
230 driving timing control circuit
300 source driver (data signal line driving circuit)
400 gate driver (scanning signal line driving circuit)
500 display unit (liquid crystal panel)
600 backlight (planar lighting device)
650 backlight driving circuit
Cp pixel capacitance
Ep pixel electrode
Ec shared electrode
GLi scanning signal line (i=1 to N)
GLai, GLbi scanning signal line (i=1 to N)
SLj data signal line (j=1 to M)
SLaj, SLbj data signal line (j=1 to M)
G(i) scanning signal (i=1 to N)
S(j) data signal (j=1 to M)
Sa(j), Sb(j) data signal (j=1 to M)
P(i, j) pixel formation unit (i=1 to N, j=1 to M)
P(k, j) pixel formation unit (k=1 to 2N, j=1 to M)

The invention claimed is:

1. A display device which is an active-matrix-type display device configured to display an image using a progressive image signal which is an image signal based on progressive scanning, comprising:

a display unit including a pixel array made up of a plurality of pixel formation units disposed in a matrix shape; and a display driving circuit including a first frame memory and a second frame memory, the display driving circuit configured to drive the display unit based on the progressive image signal by, driving, during a frame period while image display is performed based on a first signal which is one frame signal of two adjacent frame signals included in the progressive image signal, the display unit so that images of odd-numbered scanning lines in an image that the first signal represents are formed of a pixel formation unit group in odd-numbered scanning lines in the pixel array, and also, a black display line is formed of a pixel formation unit group in even-numbered scanning lines in the pixel array, driving, during a frame period while image display is performed based on a second signal which is the other frame signal of the two adjacent frame signals, the display unit so that images of even-numbered scanning lines in an image that the second signal represents are formed of a pixel formation unit group in even-numbered scanning lines in the pixel array, and also, a black display line is formed of a pixel formation unit group in odd-numbered scanning lines in the pixel array, obtaining a signal value two frame ahead of the progressive image signal by sequentially writing to the first frame memory and reading from the first frame memory a signal value from which a signal value corresponding to a pixel which makes up the black display line from a signal value that the progressive image signal indicates has been excluded, and writing to the second frame memory and reading from the second frame memory the signal value readout from the first frame memory, obtaining an enhanced image signal in which temporal change in the progressive image signal is enhanced by comparing a signal value of the current frame in the progressive image signal with the signal value two frames ahead, and driving the display unit based on the enhanced image signal.

2. The display device according to claim 1, wherein the black display line formed of a pixel formation unit group of the even-numbered scanning lines, and the black display line formed of a pixel formation unit group of the odd-numbered scanning lines are displayed with lower luminance than 10% of the maximum luminance.

3. The display device according to claim 1, wherein the black display line formed of a pixel formation unit group of the even-numbered scanning lines, and the black display line formed of a pixel formation unit group of the odd-numbered scanning lines are displayed with a luminance value of between 1% and 10% of a maximum luminance of the display device.

4. The display device according to claim 1, wherein the display driving circuit includes a signal format converter configured to generate the progressive image signal by receiving an input image signal based on interlaced scanning, and changing a scanning mode of the input image signal into a progressive scanning mode, and also changing the frame frequency of the input image signal into twice as much as thereof.

5. The display device according to claim 1, wherein the display driving circuit generates an interlace image signal by replacing, of two adjacent frames in the progressive image signal, pixel values equivalent to even-numbered scanning lines with a black pixel value in one frame, and replacing pixel values equivalent to odd-numbered scanning lines with a black pixel value in the other frame, and drives the display unit based on the interlace image signal.

6. The display device according to claim 1, wherein the display unit further includes a plurality of scanning signal lines extending in a first direction, and a plurality of data signal lines which extend in a second direction and intersect with the plurality of scanning signal lines;

and wherein the plurality of pixel formation units are disposed in a matrix shape along the plurality of data signal lines and the plurality of scanning signal lines;

and wherein each of the scanning signal lines corresponds to any one of a plurality of sets of pixel formation unit rows to be obtained by grouping the plurality of pixel formation units with two pixel formation unit rows mutually adjacent and extending in the first direction in the pixel array as one set, and also connects to each pixel formation unit included in two pixel formation unit rows which make up the corresponding set;

and wherein each pixel formation unit row extending in the second direction in the pixel array corresponds to any one of a plurality of sets of data signal lines to be obtained by grouping the plurality of data signal lines with two adjacent data signal lines as one set, and one of two data signal lines which make up each set is connected to one of two pixel formation units to be connected to the same scanning signal line of pixel formation units included in a pixel formation unit row corresponding to the set, and the other of the two data signal lines is connected to the other of the two pixel formation units;

and wherein the display driving circuit includes a scanning signal line driving circuit configured to selectively activate the plurality of scanning signal lines, and a data signal line driving circuit configured to generate a plurality of data signals which represent an image to be displayed on the display unit based on the progressive image signal, and to apply these to the plurality of data signal lines.

7. The display device according to claim 6, wherein two pixel formation units adjacent in the second direction which are mutually connected to different scanning signal lines are connected to the same data signal line.

8. The display device according to claim 6, wherein the data signal line driving circuit generates the plurality of data signals so that data signals having a mutually different polarity are applied to two data signal lines corresponding to each pixel formation unit row extending in the second direction in the pixel array.

9. The display device according to claim 6, wherein the data signal line driving circuit generates the plurality of data signals so that data signals having a mutually different polarity are applied to two data signal lines connected to two pixel formation units adjacent in the first direction in the pixel array respectively.

10. The display device according to claim 6, wherein the data signal line driving circuit generates the plurality of data signals so that the polarities of data signals to be applied to the plurality of pixel formation units via the plurality of data signal lines invert for each even frame period.

11. The display device according to claim 1, further comprising:

a planar lighting device configured to irradiate light on a rear face of the display unit; and a backlight driving circuit configured to turn on and turn off the planar lighting device in increments of predetermined areas corresponding to a predetermined number of scanning lines in conjunction with scanning for displaying the image using the display unit based on the progressive image signal;

wherein the display unit is a liquid crystal panel configured to display the image by controlling transmittance of light from the planar lighting device according to driving voltage to be given to each pixel formation unit based on the progressive image signal;

and wherein the backlight driving circuit turns on and turns off the planar lighting device in increments of the predetermined areas so that of each frame period for forming a pixel of the image using each pixel formation unit, light is not irradiated on the pixel formation unit from the planar lighting device by a predetermined period.

12. The display device according to claim 11, wherein the backlight driving circuit turns on and turns off the planar lighting device in increments of the predetermined areas so that the predetermined period is equal to or greater than ½ of one frame period.

13. The display device according to claim 11, wherein the backlight driving circuit includes a plurality of low-pass filters corresponding to the number of the predetermined areas in the planar lighting device;

wherein the backlight driving circuit gives a plurality of driving signals for turning on and turning off each of the predetermined areas in the planar lighting device to the planar lighting device via the plurality of low-pass filters respectively.

14. The display device according to claim 11, wherein the backlight driving circuit turns on and turns off the planar lighting device in increments of the predetermined areas so as that light is irradiated, by a predetermined period including before and after a start point-in-time of each frame for each pixel formation unit forming a pixel which makes up the black display line, on the pixel formation unit from the planar lighting device.

15. The display device according to claim 11, wherein the planar lighting device includes a plurality of light-emitting diodes as light sources.

16. The display device according to claim 1, wherein the display driving circuit includes a frame frequency converter configured to, receive an input image signal generated based on the progressive scanning, and generate the progressive image signal by doubling a frame frequency of the input image signal.

* * * * *